US006070723A

United States Patent [19]

Lewis

[11] Patent Number: 6,070,723

[45] Date of Patent: Jun. 6, 2000

[54] RECLOSABLE PACKAGE AND METHOD

[75] Inventor: Gregg S. Lewis, Middleton, Wis.

[73] Assignee: Portage Plastics Corp., Portage, Wis.

[21] Appl. No.: 09/228,183

[22] Filed: Jan. 11, 1999

[51] Int. Cl.[7] ..... B65D 85/20

[52] U.S. Cl. ..... 206/335; 206/470; 206/459.5; 220/326; 220/837

[58] Field of Search ..... 206/459.5, 461, 206/467–471, 335; 220/837, 839, 326

[56] References Cited

U.S. PATENT DOCUMENTS

| | | | |
|---|---|---|---|
| 2,892,538 | 6/1959 | Middleton, Jr. et al. | 206/469 |
| 3,379,774 | 4/1968 | Tjaden | 206/470 |
| 4,005,776 | 2/1977 | Seeley | 206/470 |
| 4,058,212 | 11/1977 | Wyslotsky | 206/470 |
| 4,106,621 | 8/1978 | Sorenson | 206/470 |
| 4,202,464 | 5/1980 | Mohs et al. . | |
| 4,236,636 | 12/1980 | Kuchenbecker . | |
| 4,344,533 | 8/1982 | Olsen . | |
| 4,475,881 | 10/1984 | Borst et al. . | |
| 4,570,818 | 2/1986 | Borst et al. . | |
| 4,602,719 | 7/1986 | Borst . | |
| 4,739,883 | 4/1988 | Mohs et al. . | |
| 4,739,900 | 4/1988 | Borst . | |
| 4,917,261 | 4/1990 | Borst . | |
| 4,930,627 | 6/1990 | Borst et al. . | |
| 4,948,267 | 8/1990 | Kaldenbaugh . | |
| 4,986,438 | 1/1991 | Borst . | |
| 5,012,927 | 5/1991 | Borst . | |
| 5,027,947 | 7/1991 | Reighart . | |
| 5,038,936 | 8/1991 | Borst . | |
| 5,040,680 | 8/1991 | Wilson et al. . | |
| 5,077,064 | 12/1991 | Hustad et al. . | |
| 5,147,035 | 9/1992 | Hartman . | |
| 5,161,687 | 11/1992 | Kornell et al. . | |
| 5,209,354 | 5/1993 | Thornhill et al. | 206/470 |
| 5,405,629 | 4/1995 | Marnocha et al. . | |
| 5,579,288 | 11/1996 | Malloy et al. | 206/459.5 |
| 5,582,853 | 12/1996 | Marnocha et al. . | |
| 5,595,300 | 1/1997 | Paik et al. | 206/470 |
| 5,624,057 | 4/1997 | Lifshey . | |
| 5,664,303 | 9/1997 | Johnson . | |
| 5,775,516 | 7/1998 | McCumber et al. . | |
| 5,819,939 | 10/1998 | Boyer . | |
| 5,899,334 | 5/1999 | Domerchie et al. | 206/470 |

*Primary Examiner*—Jim Foster

*Attorney, Agent, or Firm*—Boyle Fredrickson Ziolkowski S.C.

[57] ABSTRACT

A reclosable package and method having an integral reclosable door adjacent one end that permits article removal from the end of the package. The package is comprised of a thermoformed blister body joined to a thermoformed backing body. The blister body has sidewalls, endwalls and a peripheral flange broken into a first section adjacent the door where the height of the sidewalls decrease and a second section opposite the door with the first section angled relative to the second section. The backing body carries the door and has an integral peripheral rib inboard of a peripheral flange with the flange having a first section about the door and a second section disposed away from the door. The rib has a pair of longitudinally-extending sections divided by a notch that preferably is a transverse rib that causes the door to bend about a desired fold line that runs generally through or adjacent the ribs or notches when urged away from a closed position. In a preferred method, after performing a multilevel trim operation to trim the multiplanar flanges of one or both the blister body and the backing body, the two bodies are joined at the flange sections about a portion of the periphery to adjacent the fold line using an energy welding process, preferably RF welding, that produces a narrow tear seam that enables finished package flange width to be minimized to thereby also minimize package width.

60 Claims, 20 Drawing Sheets

RECLOSABLE PACKAGE AND METHOD

FIELD OF THE INVENTION

The present invention relates to a reclosable package and method of making the same and more particularly to a reclosable package having an integral reclosable door.

BACKGROUND OF THE INVENTION

Any time a purchased article is returned by a consumer, it presents a problem to the retailer taking back the article. If the package containing the article is unopened, the package and article can simply be returned to the spot on the shelf they previously occupied. However, if the package has been opened, the retailer is faced with a dilemma of whether to have the article repackaged or simply to attempt to repair the package and return it to the shelf. Unfortunately, a taped up or poorly repaired package is often undesirable to a prospective purchaser because the prospective purchaser perceives the article in the package as being somehow blemished or less than new. When this occurs, the article can remain unsold for an undesirably long time causing the retailer to lose profits. Unfortunately, the longer the article remains unsold, the less profit made by the retailer. Ultimately, if an article remains unsold for too long, the retailer will have either to significantly discount its price or have it repackaged and returned. Either way the retailer's profits are undesirably lessened.

Packaging manufacturers have developed many kinds of reclosable packaging in an effort to help solve this problem. Yet, the reclosable packaging must also be able to display the article in the package, as well as any associated graphics on a card of the package, in a manner that is aesthetically pleasing to a prospective purchaser while permitting access to the article in a manner that allows the article to be removed from the package.

For example, many types of reclosable packaging have a forwardly facing access opening covered by a front-opening door connected by a hinge to another part of the packaging. One known method of keeping the door closed over the access opening is to use an adhesive label, such as in the manner disclosed in U.S. Pat. No. 4,930,627. Another known method of keeping the door closed, such as is disclosed in U.S. Pat. No. 4,739,883, is to use interlocking dimples that releasably secure the door to another portion of the packaging such that the door is retained by the dimples in the closed position. It is also not unusual for a door that is to be held in the closed position by these dimples to be formed entirely from a front-half or rear-half of the package such that the package is a clamshell configuration. In a third known method of keeping the door closed, a card received in a track in the packaging can be slid between an open position uncovering the opening and a closed position covering the opening. Usually, in all of these instances, a label, such as a tamper-proof or tamper-evident label or another aid that undesirably requires an additional manufacturing step is used to keep the door or card over the opening from moving away from the closed position.

While each of these configurations has advantages, each also has drawbacks. For example, for those packages that require a label to keep the door closed, replacing the label when a package is returned takes time, utilizes labor, and costs money. Moreover, many reclosable packages, including the package disclosed in the '249 patent, are rather complicated in shape and costly to manufacture. For clamshell packages where the door utilizes locking dimples, the dimples can be disadvantageous because their performance is extremely sensitive to manufacturing tolerance variations and, as a result, there is often a wide variance in the force required to open and close the door. Moreover, none of these reclosable package configurations can dispense articles out an end of the package.

What is needed is a reclosable package into which an article can be reinserted and returned to a store shelf or display area without a prospective customer detecting that the package and article were previously returned. What is needed is an access door that does not require a label or the like to keep it closed. What is also needed is a reclosable package where articles, including articles longer than the package width, can easily be removed from and inserted into the package from one end. What is further needed, is a package that achieves at least some or all of these objectives while being quick, simple, and inexpensive to manufacture.

SUMMARY OF THE INVENTION

A reclosable package having an integral reclosable door at one end that permits an article in the package to be removed out the package end when the door is opened and which can be easily returned to and retained in the closed position. The package has a bubble-shaped blister body made of a thin and resilient thermoformed material that is mounted to a backing body made of a thin and resilient thermoformed material that has a rib, that preferably extends about its periphery, to help impart stiffness and crush resistance. To encourage the door to bend along a desired fold line when being opened, the rib has a notch that weakens the rib at or adjacent the location of the desired fold line. The door has a lip that contacts and preferably engages a portion of the package such that an interference fit is created between them that opposes release of the door from the closed position without manual application of sufficient force. By this advantageous reclosable package construction, the door remains closed without requiring any label or other aid to keep it closed.

A preferred package embodiment is comprised of a pair of joined package halves both made of a resilient thermoformable material with one of the package halves serving as a backing body and the other of the package halves being constructed with a bubble-like body and serving as a blister. The rib and door are integrally formed in one of the package halves with the rib and door preferably formed in the backing body package half. To save weight and space, the backing body can be made of a relatively thin thermoformable material with the rib imparting sufficient rigidity and crush resistance such that a thicker non-elastomeric card is not needed.

The backing body preferably is formed of a sheet of thermoformable material with the rib extending about its periphery that is, in turn, located inboard of a peripheral flange. The flange has a first flange section that is located on one side of the notch and which extends about a portion of each side of the backing body and along one of its ends. A second flange section is located on the other side of the notch and preferably extends around three sides of the door. Each flange section preferably has two portions that extend generally longitudinally relative to the package and one portion that extends generally transversely. At least when the door is closed, the longitudinally extending flange portions of the second flange section are disposed at an angle relative to the longitudinally extending flange portions of the first flange section such that the first and second flange sections do not lie in the same plane.

The rib has a pair of spaced apart generally longitudinally extending sections and a pair of spaced apart generally transversely extending sections. Each longitudinally extending section is notched at or adjacent the desired fold line dividing the section into a first portion on one side of the notch and a second portion on the other side of the notch. In a preferred notch embodiment, each notch comprises a generally transversely extending hinge rib that preferably has a generally triangular cross section. Where needed, a web of material can extend across an apex of the notch. The hinge ribs are spaced about the same distance from each package end to ensure that the fold line is disposed between the package ends in a generally transverse direction relative to the lengthwise direction of the package. When the door is closed, one of the rib portions is disposed at an angle relative to the other of the rib portions with one of the transversely extending rib sections disposed at a different elevation relative to the other of the transversely extending rib sections.

The blister body is formed such that it has a pair of spaced apart generally longitudinally extending sidewalls and a pair of spaced apart transversely extending endwalls. At the end adjacent the door, the sidewalls are tapered such that the height of the adjacent endwall becomes increasingly less than the height of the opposite endwall. Preferably, the beginning of the tapered portion of each sidewall is at or adjacent the fold line and borders part of the door when the door is closed. The peripheral flange has a pair of spaced apart generally longitudinally extending sidewall sections and a pair of spaced apart endwall sections. Each sidewall flange section is comprised of a first planar flange portion and a second planar flange portion with the first planar flange portion and the second planar flange portion meeting at or adjacent the fold line and disposed at an angle relative to each other. If desired, each planar flange portion adjacent the door can taper inwardly away from the sidewall to help frictionally capture and retain the door when the door is closed.

The door has an upraised portion and a front lip that preferably engages with the shorter endwall of the blister body creating interference fit therebetween such that when the door is closed it remains closed absent the application of sufficient force. In a preferred embodiment, the angle of the lip and the angle of the endwall are substantially parallel to help create the interference fit. Preferably, the lip and endwall angle is generally perpendicular to one or both outer walls of the backing body and the blister body. Preferably, a snap fit is created between the door and endwall when the door is closed.

In one package embodiment, the door has a portion of a flange that forms a first hanger tab in which there is a hanger hole. The backing body preferably also has a portion of a flange that extends parallel to the first hanger tab and forms a second hanger tab. The second hanger tab preferably also has a hanger hole. The tabs overlap with the holes generally in alignment for both receiving a peg of a display board. When hung from a peg, the peg preferably helps prevent the door from opening by itself.

As a result of this novel reclosable package construction, a relatively thin, flexible and resilient material can be used having a thickness of no greater than about 0.050 inches. Such a package construction advantageously minimizes flange width such that the width of the article-receiving cavity is nearly the same as the total width of the package. For example, in one package embodiment, the peripheral flange width at the sides of the package is no greater than about ⅛ of an inch and preferably no greater than about 3/32 of an inch. By maximizing cavity width and cavity volume by minimizing flange width, the package can be made narrower for an article of a given size. For example, in a preferred packaging application, the article is a windshield wiper blade or wiper blade refill having a length greater than package width and typically two or more times the package width. As a result of minimizing package width, the package can be made to fit a peg-type display board having pegs spaced about one inch on center, i.e about two inches apart.

In a preferred package arrangement, at least a portion of the outer walls of the backing body and the blister body are not opaque to permit a prospective purchaser to see through at least part of the outer package walls. The package has a card containing graphics and text received in the cavity that is disposed between an article in the cavity and one of the outer walls. The package is hung by a peg such that the card is immediately facing or exposed to the prospective purchaser. Preferably, the card completely or partially obscures the article and is located between a prospective purchaser and the article in the package. The opposite outer wall preferably can have indicator indicia and can have labels formed in the wall to help the prospective purchaser estimate the length of the article in the package or a used article brought by the prospective purchaser that the prospective purchaser is seeking to replace.

In a method of making the package, sheets of a thermoformable material are thermoformed such that one of the sheets has forms a blister having a construction similar to or the same as that described above and the other of the sheets forms a backing body having a construction similar to or the same as that described above. The flanges of the blister are trimmed in a multilevel trimming operation that such that trimming of the flanges occurs in more than one plane. The flanges of the backing body are trimmed. Preferably, the backing body trimming operation can also be a multilevel trim operation.

After trimming, the blister body is positioned so as to receive an article in its cavity. After the article is received in the cavity, the backing body and blister body are brought together such that one of the portions of each sidewall flange section of the blister body contacts the first flange section of the backing body and they are sealed together. The flange portions about the door are not sealed to each other to permit the door to be opened and closed.

In a preferred joining method, the one sidewall flange portion and the first flange section are joined together by a high energy density welding process that can employ a beam of the energy. In a preferred embodiment, the welding process is a radio frequency ("RF") welding process that also creates a tear seam. After joining the blister body to the backing body, excess flange material can be removed by manually tearing along the tear seam. Such a RF welded tear seam advantageously enables flange width to be minimized which thereby also advantageously minimizes package width.

In another preferred method, a card that can contain graphics and text is placed in the cavity against the outer wall of the blister body before the article is placed in the cavity. The card can be retained against or adjacent the outer wall by a plurality of pairs of fingers that extend into the cavity and which can be integrally molded into the sidewalls during thermoforming.

It is an object of the invention to produce a reclosable package having a reclosable door at one end that enables articles having a length longer than the width of the package to be dispensed from the end.

It is another object and advantage of the invention to provide a package with a door that can be reclosed in a manner that keeps the package looking new so that a returned article or articles can be put back into their original package without the package having to be repaired, retaped or the like.

It is a feature of the invention that uses a multilevel or multiplanar trim operation in a method of making the package to accommodate flanges having sections located on two different planes required to produce a reclosable door of or like the disclosed construction at one end of the package that can be opened to permit an article to be dispensed out the end of the package.

It is a feature of the invention that uses a multilevel or multiplanar trim operation in a method of making the package to accommodate flanges having sections located on two different planes desired to produce a reclosable door at one end of the package that can be opened to permit an article to be dispensed out the end of the package and which is retained in the closed position without the use of a label, staking, an adhesive, or the like.

It is another object of the invention to use a method of manufacture where a multilevel trim operation is performed before RF welding is performed to minimize flange width to minimize package width while maximizing usable package volume in order to maximize the density of the packages that can be displayed in a store or other retail setting.

It is still another object of the invention to use thin, resilient, and flexible thermoformable material to produce a package that does not need a flat, thicker blistercard of conventional cardboard or rigid plastic construction for support and rigidity.

It is still another object of the invention to produce a package that needs no card for support, structural rigidity and crush resistance.

It is an advantage of the invention that the backing body has a peripheral rib to impart structural rigidity and crush resistance to the package to enable relatively thin material, as thin as 0.050 inch or thinner, to be used to form the backing body.

It is an advantage of the invention that the flanges are so thin such that the article-receiving cavity width is nearly as wide as the total package width.

It is an advantage of the invention that the peripheral flanges can be made 3/32 of an inch or narrower to minimize total package width.

It is an object of the invention to produce a package having visually perceptible indicators that enable a prospective purchaser to inspect and estimate length.

It is still another object of the invention to produce a package having integrally formed indicators and markings.

It is a further object of the invention to produce a package having a door at one end that can open to allow an article or a plurality of articles having a length greater than the package width to be easily removed out the end of the package.

It is a still further object of the present invention to provide a reclosable package that can also be a display package.

It is a still another object of the present invention to provide a reclosable package having a reclosable door attached to a portion of the package by an integral living hinge that can be repeatedly opened and closed several hundred times without failure.

Other objects, features, and advantages of the present invention include a reclosable package that is rugged, simple, flexible, reliable, and durable, and which is of economical manufacture and is easy to assemble, install, and use. Other objects, features, and advantages of the present method of the invention include a method of making a reclosable package that is fast, inexpensive, versatile, reduces scrap, minimizes labor required, produces a package having a maximum cavity for a given width, and which is easy to implement and use.

Other objects, features, and advantages of the present invention and method will become apparent to those skilled in the art from the detailed description and the accompanying drawings. It should be understood, however, that the detailed description and accompanying drawings, while indicating at least one preferred embodiment of the present invention and method, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout and in which.

DETAILED DESCRIPTION OF THE INVENTION

Figure 1:
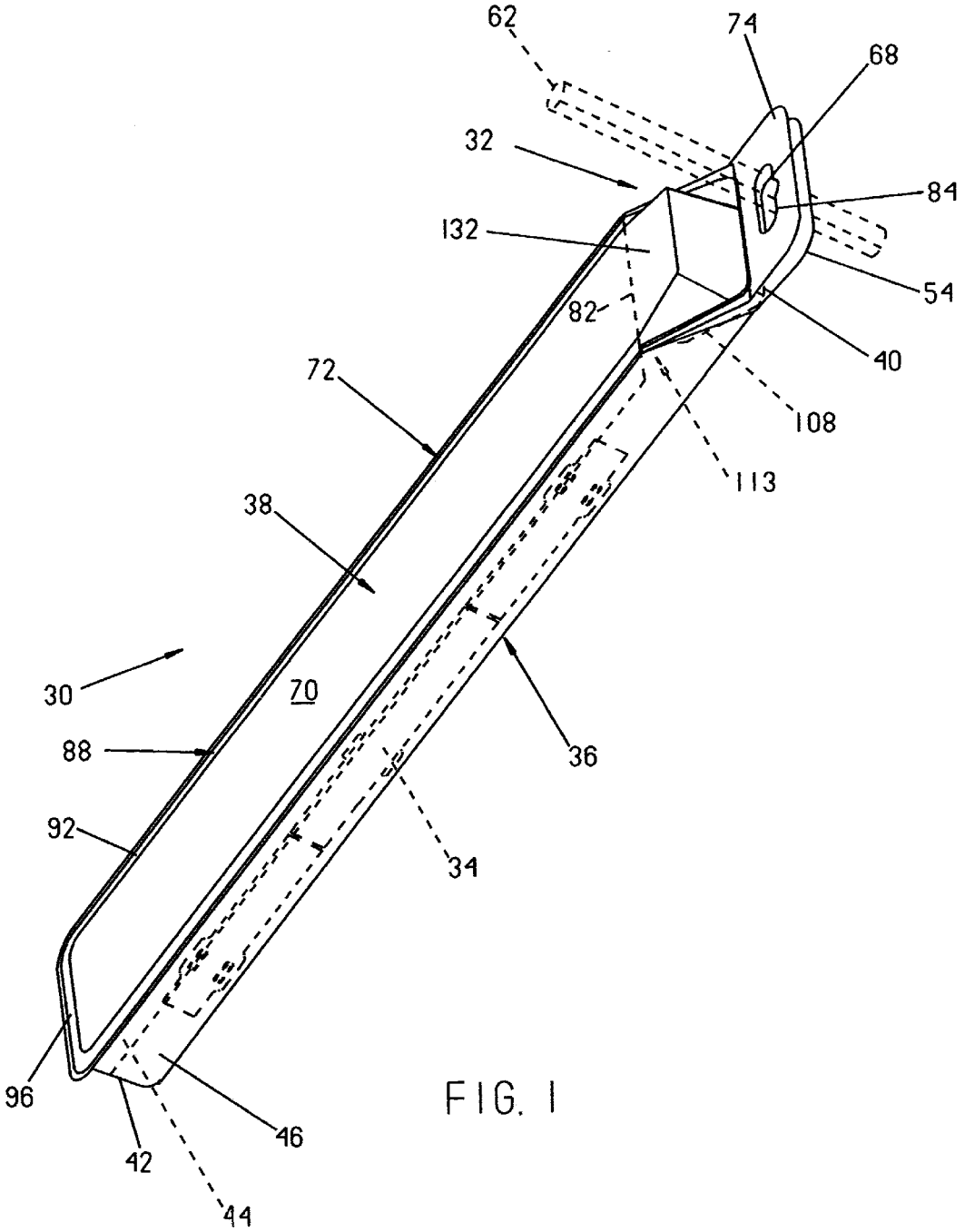
FIG. 1 is a perspective view of a reclosable display package of this invention.

FIGS. 1–7 illustrate a reclosable package 30 of this invention that has an access door 32 adjacent one end that is self-retaining in a closed position (FIG. 1) to retain an article or multiple articles within the package and which can be moved to an open position (FIG. 7) to advantageously permit withdrawal of one or more articles 34 from one end of the package 30. Such a package construction is particularly advantageous where an article 34 received in the package is long, longer than the width of the package 30, such that it is desirable, if not necessary, to remove or dispense the article 34 from one end of the package 30.

The package 30 comprises a body made of a pair of halves 36 and 38 joined together nearly about the entire periphery of the package 30 except for adjacent the door 32. The door 32 is carried by one of the package halves and is located at or adjacent one end of the package body. Although two halves joined together are shown in the drawing figures, the package 30 can comprise more than two halves or portions that are joined together.

Figure 2:
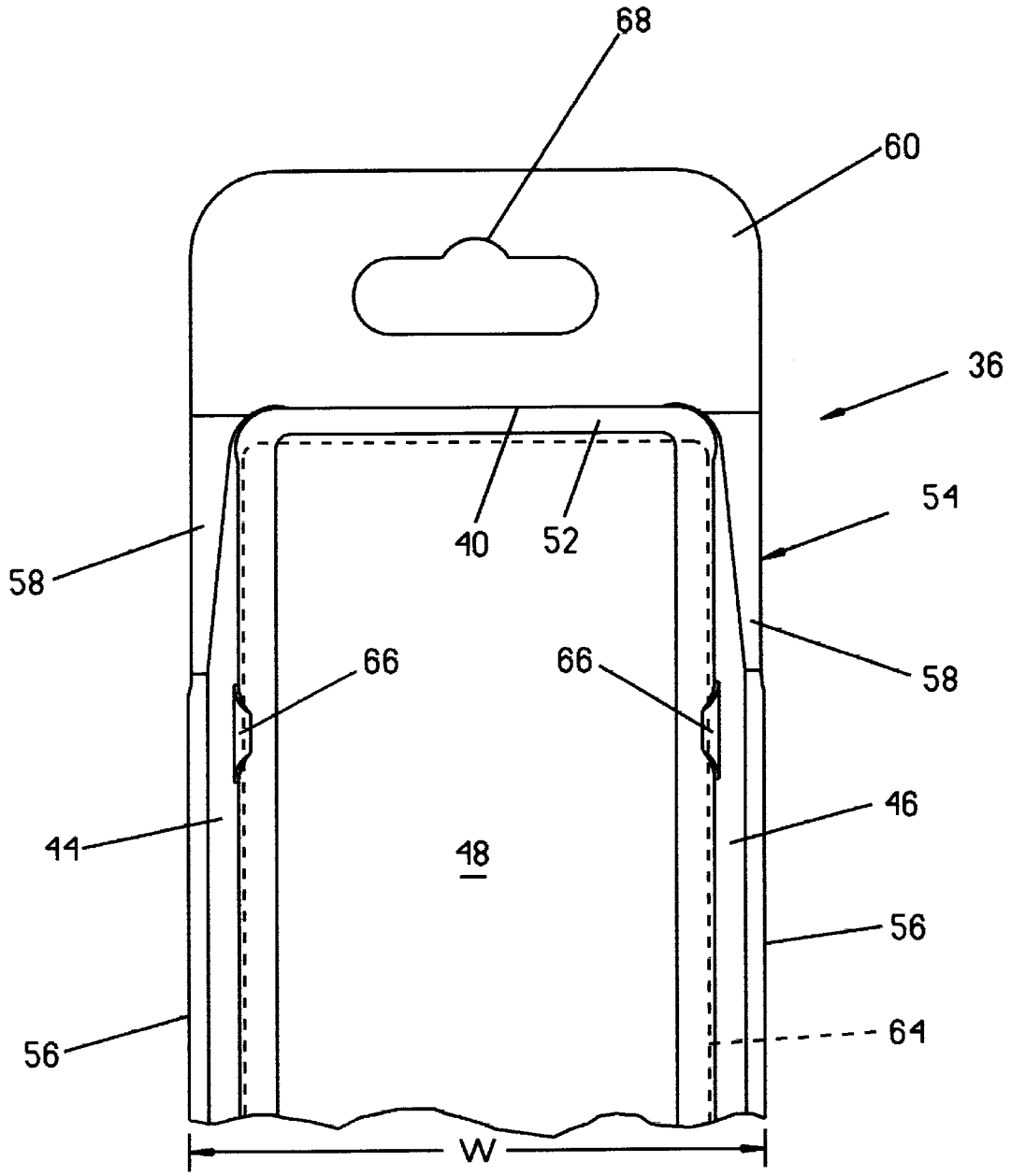
FIG. 2 is an enlarged fragmentary front plan view of one portion of the package.
Figure 3:
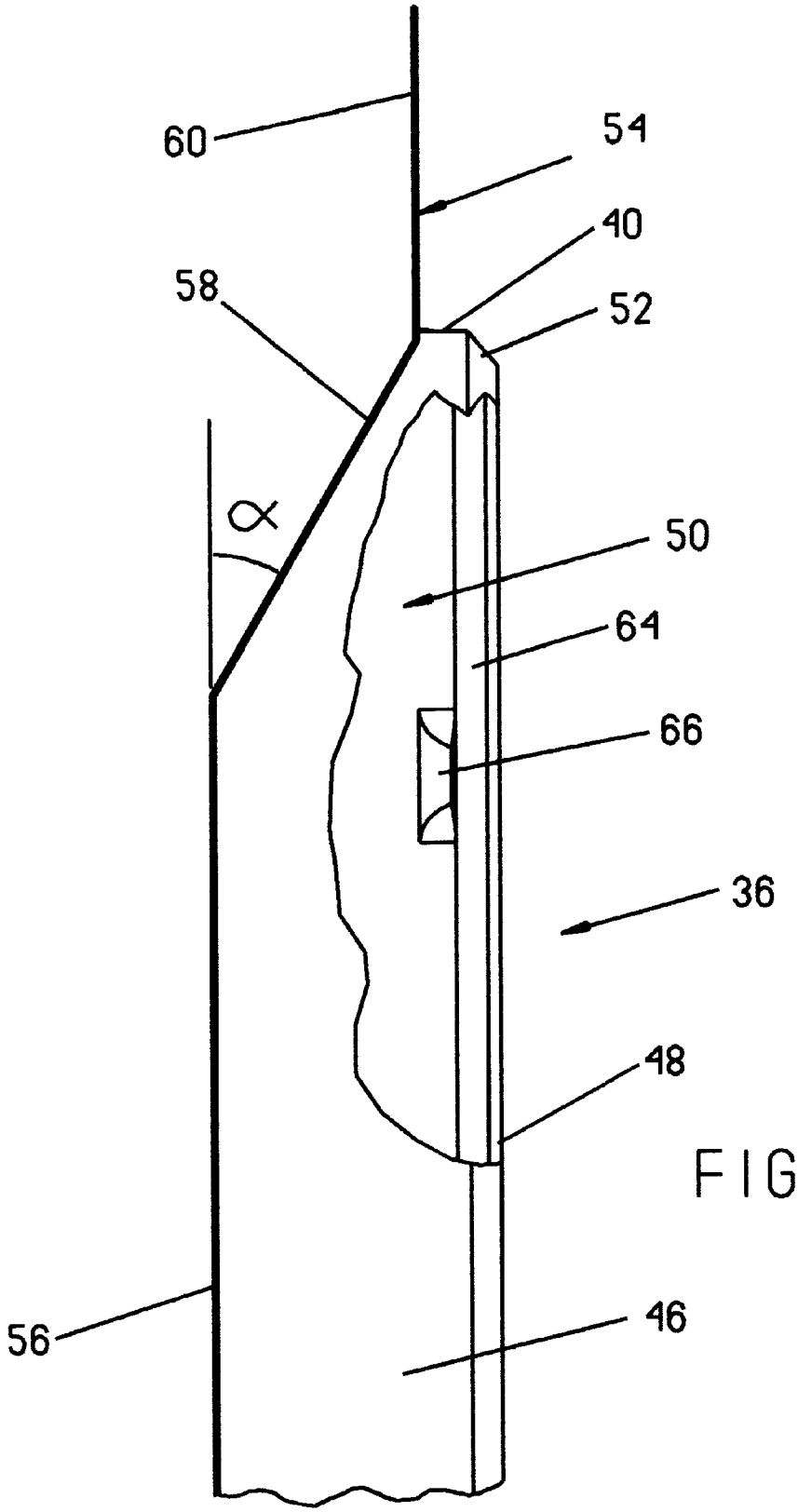
FIG. 3 is an enlarged fragmentary side view of the package portion.

A first package half 36, shown in more detail in FIGS. 2 and 3, is a bubble-shaped blister body that has an upper generally transversely-extending sidewall 40, a lower generally transversely-extending sidewall 42, and a pair of longitudinally-extending sidewalls 44 and 46 that bound an outer wall or outer surface 48 and define an article-receiving cavity 50 (FIG. 3). FIG. 2 also shows a rounded transition region 52 between each of the sidewalls 40, 42, 44 and 46 and the wall 48 that can bound the periphery of the wall 48. A flange 54 extends outwardly about the periphery of the sidewalls 40, 42, 44, and 46 and forms at least a portion of a surface to which another package half, such as package half 38, is joined. When in the closed position, a portion of the door 32 bears against the upper sidewall 40 causing the door 32 to be releasably retained in the closed position.

As is shown more clearly in FIG. 3, the flange 54 has three sections 56, 58 and 60. A first flange section 56 extends about the periphery of the lower sidewall 42 and portions of both longitudinally extending sidewalls 44 and 46. The first flange section 56 preferably is planar or substantially planar, i.e. generally flat, and provides all or substantially all of the surface to which another package half, such as package half 38, is joined.

A second flange section 58 is disposed at an acute angle, $\alpha$, relative to the first flange section 56. The second flange section 58 is located immediately adjacent the first flange section 56 in the region of the door 32. The second flange section 58 extends outwardly from a portion of both longitudinally extending sidewalls 44 and 46 adjacent the door 32 and from the upper sidewall 40. The second flange section 58 is also planar but is not coplanar with the first flange section 56. Preferably, the plane in which the second flange section 58 lies is disposed at angle, $\alpha$, relative to the plane in which the first flange section 56 lies. In one preferred embodiment, $\alpha$, is about 30° but can range between about 20° and about 45°. Such a preferred angle and angular range are not merely design choices. Rather, as will be discussed in more detail herein, the preferred angle and angular range help enable the door 32 to be retained in the closed position by the package half 36.

Figure 4:
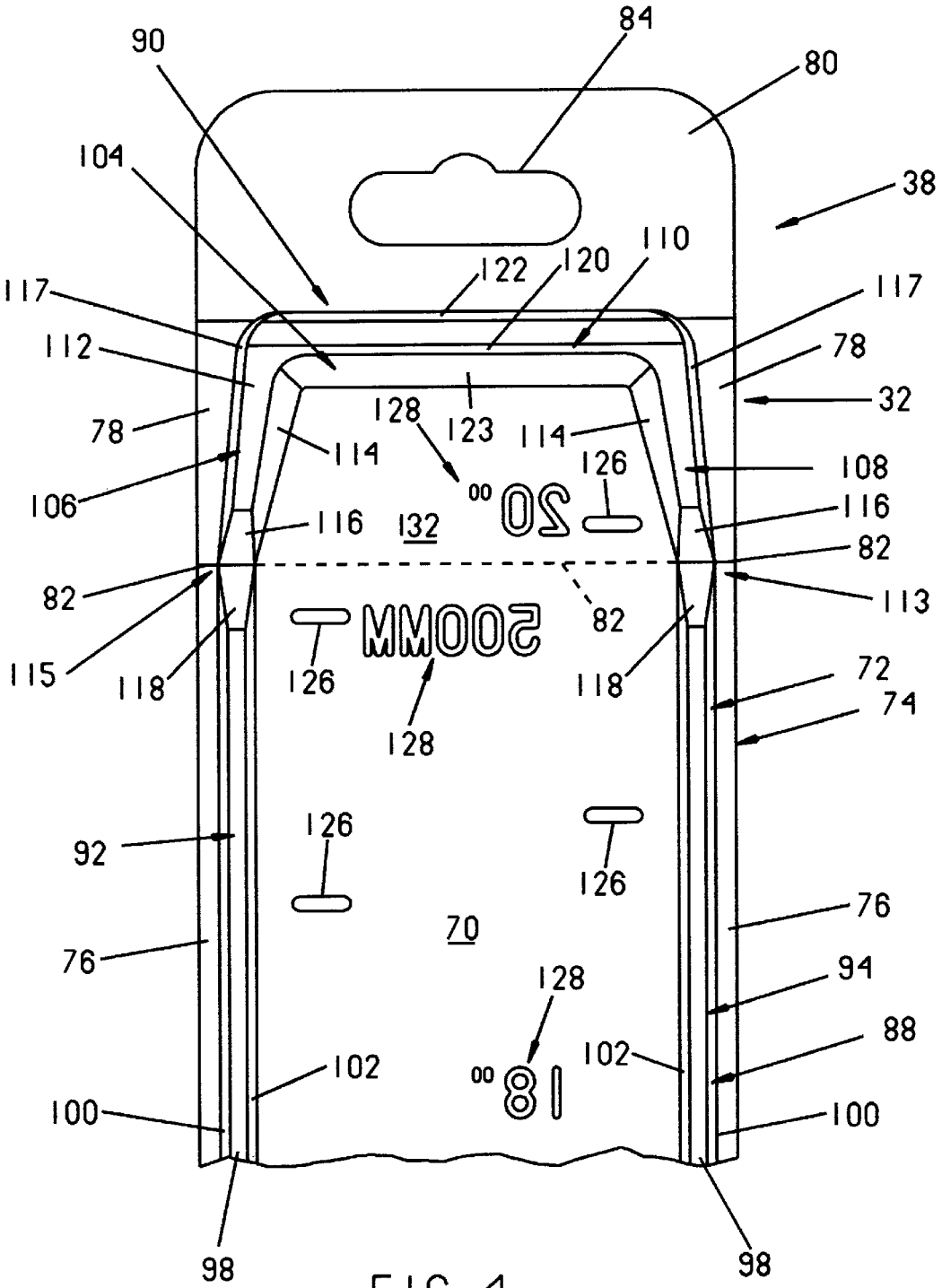
FIG. 4 is an enlarged fragmentary front plan view of another portion of the package.

A third flange section 60 extends outwardly from the second flange section 58 away from the upper sidewall 40 at the end of the package half 36 adjacent the door 32. The third flange section 60 can form a mounting tab from which the package 30 can be suspended. If desired, the third flange section 60 can be disposed in the same plane as the second flange section 58 but can be disposed at an angle relative to the plane of the second flange section 58 so that the package 30 can be hung from a vertical mounting surface, such as a wall or the like, such that the upper sidewall 40 is on top, the lower sidewall 42 is on the bottom, and at least one of the package halves 36 and 38 is disposed in a particular desired direction such as shown. If desired, the third flange section 60 can be two-dimensionally or three-dimensionally contoured. As is shown in FIG. 4, the third flange section 60 can be parallel or substantially parallel to the first flange section 56. Where it is desired to hang the package 30, to accommodate a peg 62 (shown in phantom in FIG. 1) or the like of a mounting assembly, such as a mounting assembly used in a store, the tab preferably has a hole 68 through which the peg 62 extends.

To help retain an insert or card 64, such as a card 64 containing graphics, text and the like that advertises the article 34 in the package 30, the package half 36 has a plurality of pairs of opposed and spaced apart fingers 66 that extend inwardly from each longitudinally-extending sidewall 44 and 46. The fingers 66 are spaced from the wall 48 by a distance that is about the thickness of the card 64 or greater. Preferably, the fingers 66 are integrally formed from part of one or both of the sidewalls 44 or 46. If desired, each of the fingers 66 can comprise an indention in one or both of the sidewalls.

Although the width of the cavity 50 can remain the constant along the length of the package half 36, it can narrow slightly adjacent the door 32 to help releasably capture the door 32 in the closed position and to help laterally support the door 32 when the door 32 is in the closed position. Where the cavity 50 is narrowed, the narrowing of the cavity 50 preferably is accomplished by inwardly tapering each sidewall 44 and 46 at or adjacent the end of the package 30 that is disposed adjacent the door 32.

Figure 5:
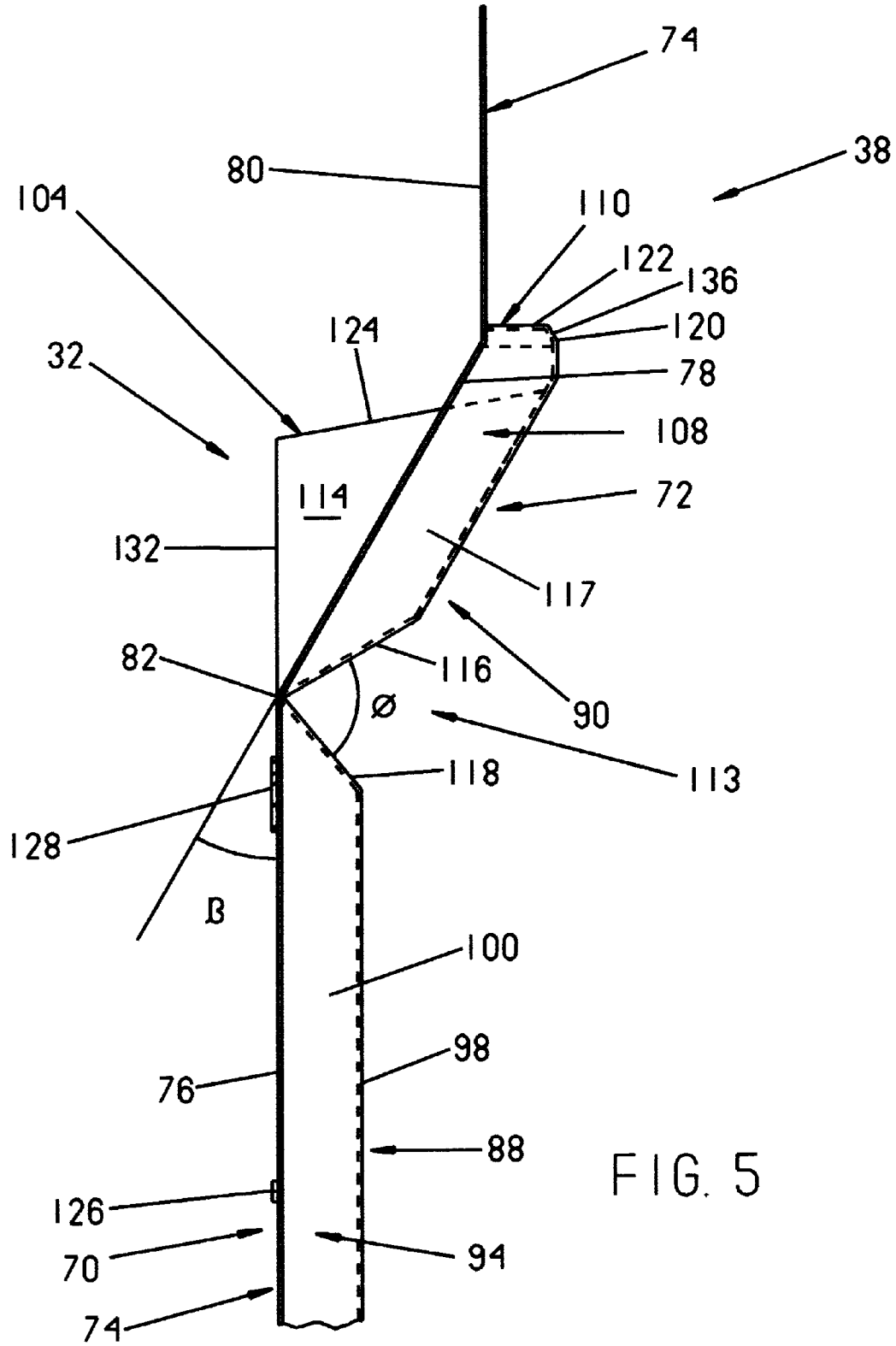
FIG. 5 is an enlarged fragmentary side view of the other portion of the package.

FIGS. 4 and 5 each illustrate a portion of a second package half 38 in more detail. The package half 38 comprises a backing body that has a longitudinally extending outer wall or surface 70 that is bounded about its periphery by (a) a recessed channel 72 that preferably functions as a rib to help impart stiffness and strength to the package half 38 and (b) an outwardly extending flange 74 that has at least a portion of it joined to the flange 54 of package half 36. The package half 38 also carries the door 32. Preferably, the door 32 is integral with the package half 38. The door 32 is generally defined by that portion of package half 38 that lies above fold line 82.

Like package half 36, the flange 74 of package half 38 has at least two flange sections and preferably has three flange sections 76, 78 and 80. A first flange section 76 extends transversely about an end of the outer wall 70 that is spaced from the door 32 and longitudinally along side of the wall 70 preferably terminating along a hinge line or fold line 82 of the door 32. Preferably, the first flange section 76 is planar or substantially planar and, as is depicted in FIG. 5, can be coplanar or substantially coplanar with the wall 70.

The first flange section 76 of package half 38 is joined to the first flange section 56 of package half 36 such that the two halves 36 and 38 form a package 30 or a substantial portion thereof. If desired, the flange sections 56 and 76 can be adhesively joined or sealed together, joined using heat, or joined using an energy welding method. Examples of suitable energy welding methods include RF welding and ultrasonic welding. In a preferred method of assembling a package 30 of this invention discussed in more detail below, the flanges 56 and 76 are preferably joined or sealed together by RF welding.

Figure 6:
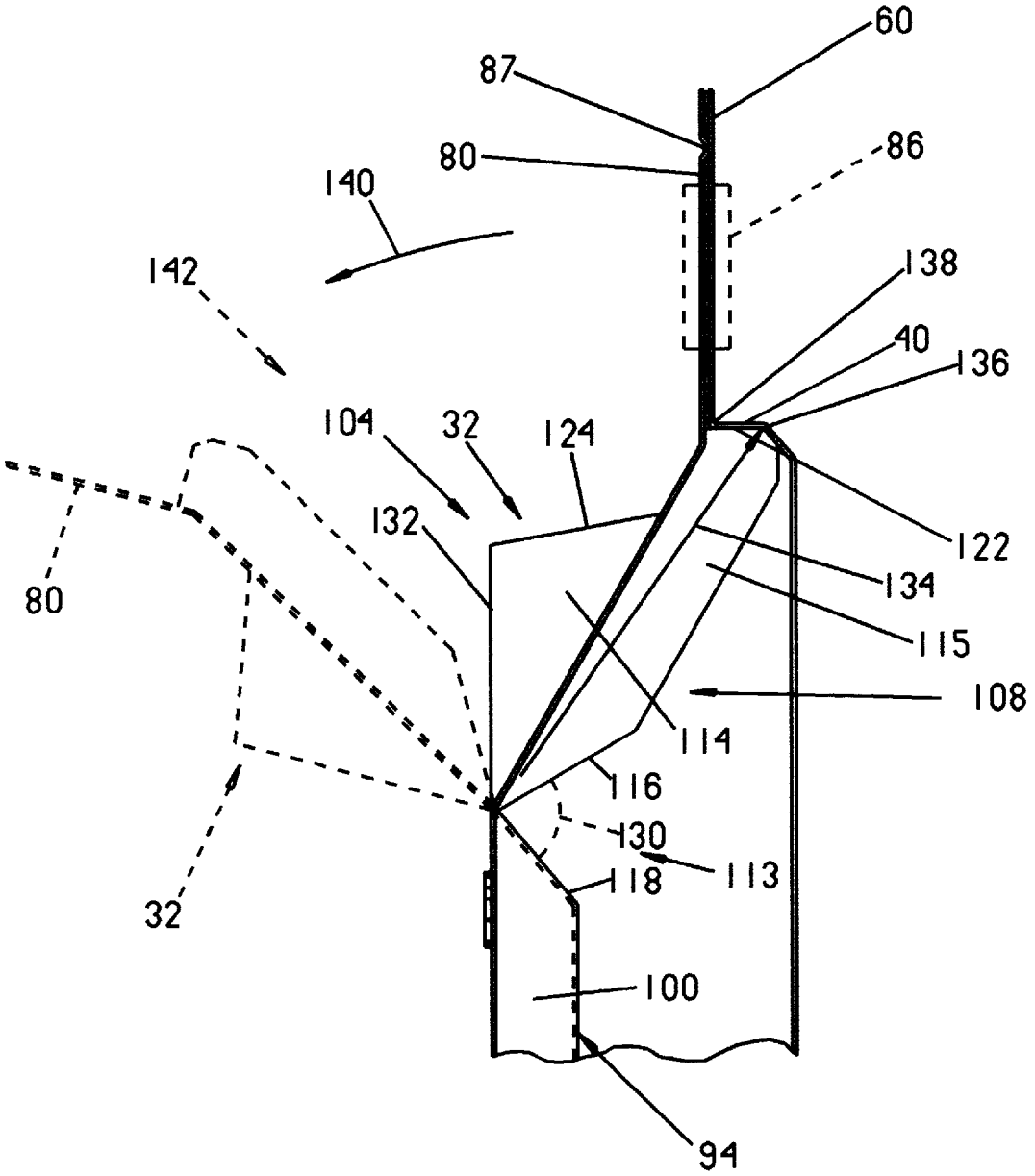
FIG. 6 is an enlarged fragmentary side view of a package with both portions assembled illustrating a reclosable door of the package in a closed position and in an open position.

A second flange section 78 extends outwardly along each side of the door 32 and can extend along an end of the package half 38 adjacent the door 32. The second flange section 78 is also planar or substantially coplanar, i.e. generally flat, with it being disposed at an acute angle, β, relative to the plane of the first flange section 76 when the door 32 is closed. In one preferred embodiment, β, is about 30° when the door 32 is closed and can range between about 20° and about 45°. The aforementioned are not mere design choices but help ensure that, for a given length of flange section 78 (i.e., length of door 32 in a direction generally parallel to a longitudinal axis of the package 30), the top wall 40 of package half 36 will interfere with the motion of the door 32, such as is depicted in FIG. 6, when in the closed position to help retain the door 32 in the closed position. The interference fit created between the door 32 and wall 40 also opposes release of the door 32 from the closed position when it pivots generally about fold line 82 when being opened.

The second flange section 78 of package half 38 is not joined or sealed to the second flange section 58 of package half 36 to permit the door 32 to be moved toward and away from package half 36. As is shown in FIGS. 1 and 6, when the door 32 is closed, the second flanges 58 and 78 lie adjacent each other generally in an overlapping relationship and can bear against each other.

The third flange section 80 extends outwardly from the package half 38 beyond the end of the package half 38 adjacent the door 32. The third flange section 80 can be planar but can be two-dimensionally or three-dimensionally contoured. Preferably, the third flange section 80 comprises a mounting tab and has a through-hole 84 that preferably is a hanger-hole for receiving a peg 62 or the like. When the door 32 is closed, the third flange section 80 of package half 38 overlaps the third flange section 60 of package half 36 preferably such that their holes 68 and 84 at least partially align. As a result of this overlapping and aligned construction, the package 30 can be hung from a peg 62 in a manner like that shown in FIG. 1 with the peg 62 helping to keep the third flange sections 60 and 80 from separating too far from each other thereby helping to keep the door 32 closed. If desired, such as is shown in phantom in FIG. 6, a label 86, such as a tamper-proof or tamper-evident label, can be placed on the package 30 such that it contacts both third flange sections 60 and 80 in a manner that keeps the flange sections 60 and 80 together and the door 32 closed. If desired, flanges 78 and 58 or flanges 60 and 80 can be staked 87 to hold the door 32 in the closed position until pulled apart with sufficient force to break the stake.

The recessed channel 72 forms two groups of ribs 88 and 90 that together encircle substantially the entire the periphery of package half 38 except for adjacent the fold line 82. A first group of ribs 88 has a pair of longitudinally extending ribs 92 and 94 that are interconnected by a transversely extending rib 96. Each of the ribs 90, 92 and 94 of the first group 88 is defined by a bottom 98 and a pair of sides 100 and 102. Where package half 38 is formed or molded such that it requires a draft angle to facilitate removal from a mold, the sides 100 and 102 preferably are angled such that the width of the bottom 98 is narrower than the opening or mouth of the rib. Where package half 38 is so formed or molded, the sides 100 and 102 have a draft angle of at least about 7° and no greater than about 15°. In a preferred embodiment, the sides 100 and 102 have a draft angle of about 10°.

A second group of ribs 90 extends around three sides of an upraised portion 104 of the door 32. The second rib group 90 has a pair of spaced apart longitudinally extending ribs 106 and 108 that are interconnected by a generally transversely-extending front rib 110. Each of the longitudinally-extending ribs 106 and 108 have a bottom 112 and a pair of sides 114 and 117 that are similar to the ribs of the first group 88. Similarly, the transversely extending front rib 110 has bottom 120 spacing apart a front wall 122 and a rear wall 123. Each of the longitudinally extending ribs 106 and 108 are generally aligned with one of the longitudinally extending ribs 92 and 94 of the first group 88.

Each aligned rib pairs 92, 106 and 94, 108 is divided by a notch 113 and 115 at or adjacent the fold line 82. Each notch 113 and 115 has a pair of surfaces 116 and 118 inclined relative to the bottom of each the ribs 92, 106, 94 and 108 that generally converge at the fold line 82 to form a hinge rib 113 and 115 that is generally transverse to the longitudinally extending ribs 92, 94, 106 and 108. Each transverse hinge rib 113 and 115 has a generally triangular or notched cross-sectional shape to introduce a region of weakness in the rib pairs 92, 106 and 94, 108 that encourages the door 32 to bend at, along, or very near a desired fold line 82 when sufficient force is applied to the door 32 to urge the door 32 away from the closed position and toward an open position that is a position disposed from the closed position. Preferably, an integral living hinge is formed in the region of the fold line 82. When the door 32 is closed, the inclined surfaces 116 and 118 of each hinge rib 113 and 115 form an angle, ϕ, that is between about 80° and about 90° and preferably no greater than about 60° as this advantageously enables simpler more inexpensive tooling to be used. If desired, the door 32 can be constructed such that the inclined surfaces 116 and 118 actually overlap and contact each other such that ϕ approaches 0°. Where package half 38 is formed by a thermoforming process, the inclined surfaces 116 and 118 of each hinge rib 113 and 115 can be joined by a web 130 of material, such as is depicted in phantom in FIG. 6.

To help provide a prospective purchaser or a person inspecting a package with an estimate of the length of the article 34 in the package 30 without opening the package 30, one or both of the walls 48 and/or 70 can have indicator indicia in the form of spaced apart marks 126 and labels 128 that identify the significance of the marks 126, namely length. By this construction, a prospective purchaser can bring a used article they are seeking to replace and compare it with the length of the article 34 in the package 30 and can do using the marks 126 as a reference. Preferably, both the marks 126 and labels 128 are integrally formed into the walls 48 and/or 70 such that the marks 126 and labels 128 are upraised, indented, or otherwise three-dimensionally contoured.

In one preferred package embodiment, depicted in FIG. 4, the outer wall 70 of package half 38 has a plurality of rows of marks 126 each spaced apart by a desired distance or increment. In one row, each of the marks 126 is spaced apart from an adjacent mark 126 by about an inch with measurement labels 128 located adjacent one of the marks 126 approximately every two inches. In another row, the marks 126 are spaced apart about twenty-five millimeters (mm) with labels 128 located about every fifty mm.

Figure 7:
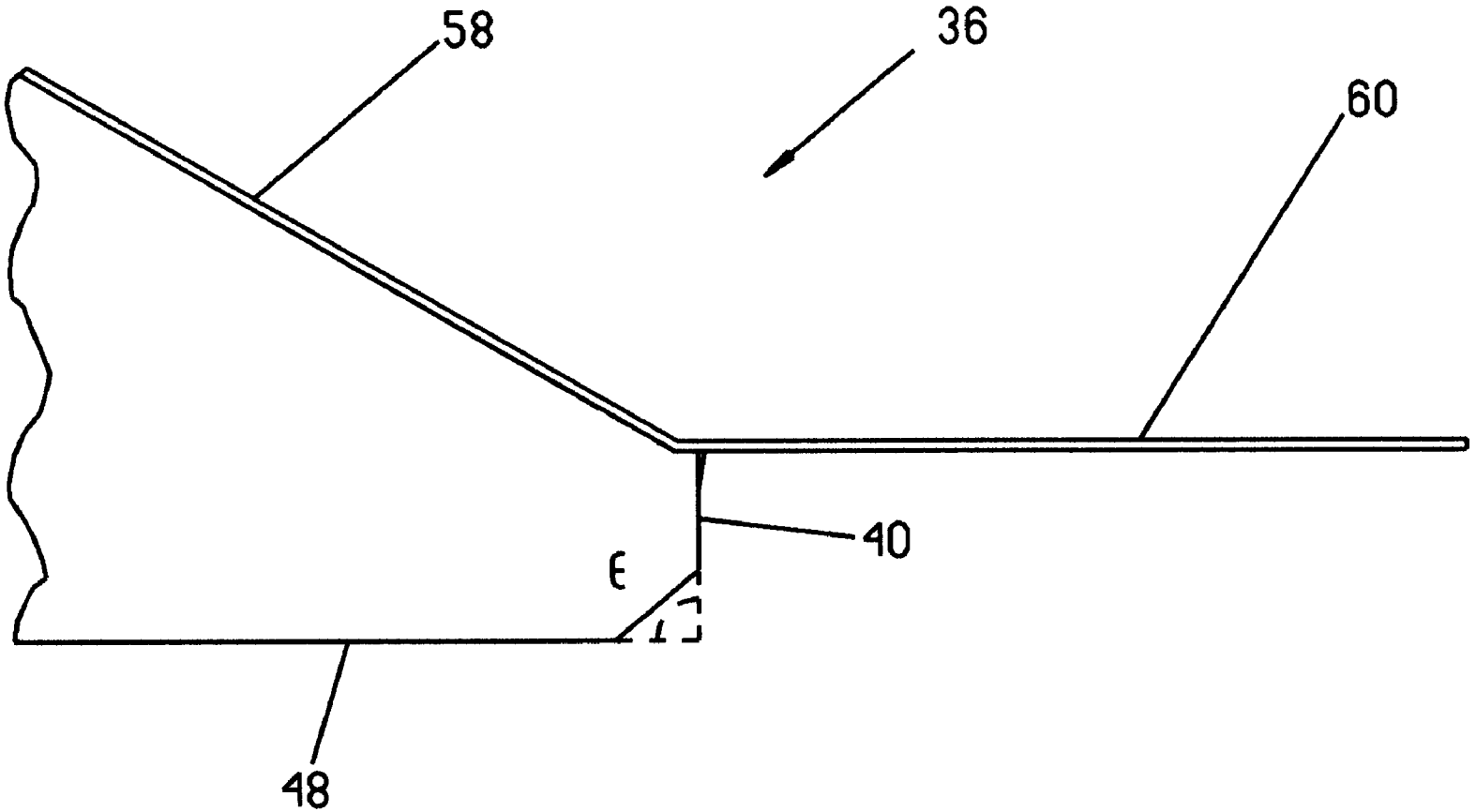
FIG. 7 is an enlarged fragmentary side view of that package portion which receives the door.

FIGS. 6 and 7 illustrate the construction and operation of the door 32 in more detail. The upraised portion 104 of the door 32 is comprised of a front surface 124 that forms one of the walls of recessed transverse rib 110, a pair of side surfaces 114 that each form one of the walls of one of the longitudinally-extending ribs 106 and 108, and an outer surface 132. In one embodiment of the package 30, the outer surface 132 of the door 32 is planar or substantially planar and preferably is parallel or substantially parallel to outer wall 70 of package half 38 when the door 32 is closed. As a result of this construction, an article 34 or a part of an article 34 can be received in the upraised portion 104 of the door 32 without the article 34 or any part thereof interfering with the opening and closing of the door 32. Thus, the door 32 advantageously can be constructed to form an integral part of the package 30 when it is closed.

As previously discussed, the door 32 is retained in the closed position by an interference fit between the front wall 122 of the door 32 and the upper transversely-extending sidewall 40 of package half 36. The door 32 is retained in the closed position because, as exemplified by a ray 134 that extends from the fold line 82 to that portion of the door 32 spaced the farthest away from the fold line 82, i.e. an outer edge 136 of the front wall 122, when the door 32 is urged in the direction indicated by arrow 140, the outer edge 136 not only contacts the interior surface of sidewall 40 but actually urges the sidewall 40 slightly outwardly away from the edge 136. Because the sidewall 40 preferably is composed of a resilient material, it returns to the position shown in FIG. 7 when the door 32 passes beyond the edge 138 of the sidewall 40. Thus, the door 32 is constructed such that the length of ray 134 would cause a part of the front wall 122 to pass through the sidewall 40 when opening the door 32, if the sidewall 40 was not resilient.

Referring to FIG. 7, to ensure that an interference fit occurs between the front wall 122 and the sidewall 40, (a) the angle, $\epsilon$, formed between the sidewall 40 and the outer wall 48 of package half 36 is between about 89° and about 91° and preferably is about 90° and (b), as is shown in FIG. 6, the front wall 122 is parallel or substantially parallel to the sidewall 40. Preferably, the front wall 122 is also disposed within about 89° and about 91° of the sidewall 40 to ensure creation of an interference fit when the door 32 is closed. Preferably, the interference fit is a snap fit such that a person closing the door 32 feels it snap into place when sufficient force is applied and it reaches the closed position.

In operation of the door 32 with the package 30 removed from any peg it was hung from, a person simply manually grasps tab 80 and pulls it away from tab 60. When the force pulling the tabs 60 and 80 apart exceeds the force of the interference fit keeping the door 32 in the closed position, sidewall 40 will flex outwardly at least slightly thereby permitting the door 32 to move relative to the sidewall 40 and package half 36. Thereafter, application of force causes the door 32 will rotate about the fold line 82 and move farther away from package half 36 exposing an access opening 142. Preferably, the access opening 142 is large enough to permit the person to reach into the package and retrieve the article 34. If desired, the package 30 can be tipped so that the access opening faces at least somewhat downwardly to allow gravity to urge the article 34 from the package 30.

When the door 32 is open, one or more articles, such as article 34, can be inserted through the opening 142 into the package 30. To close the package 30, force can be applied directly against the door 32 or to the tab 80 to urge the door 32 in a direction generally opposite arrow 140. When the edge 136 of wall 122 contacts the edge 138 of wall 40, its inclined construction (FIG. 5) causes the edge 136 to function as a wedge or ramp to help urge wall 40 slightly outwardly so as to receive the rest of the door wall 122. Preferably, further application of force causes additional relative movement between the walls 40 and 122 to occur until an audible "snap" is heard providing feedback that the door 32 is closed. When the door 32 is closed, the appearance of the package 32 preferably is virtually indistinguishable from when it was first used. Preferably, the door 32 can be opened and closed several times, at least 15 times, without its appearance changing, particularly in the region of the fold line 82.

Figure 8:
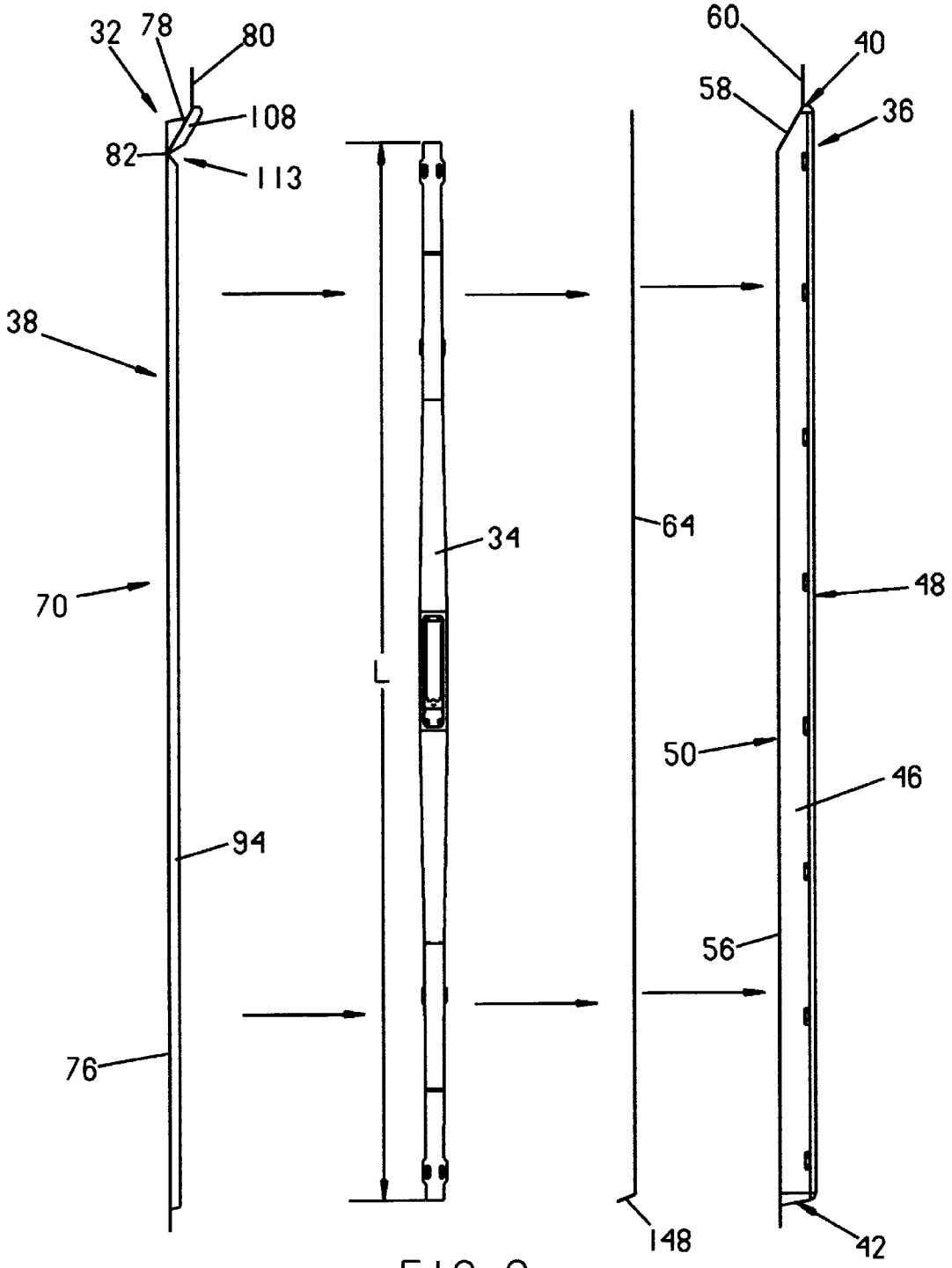
FIG. 8 is an exploded side view of one preferred package assembly and packaging application.
Figure 9:
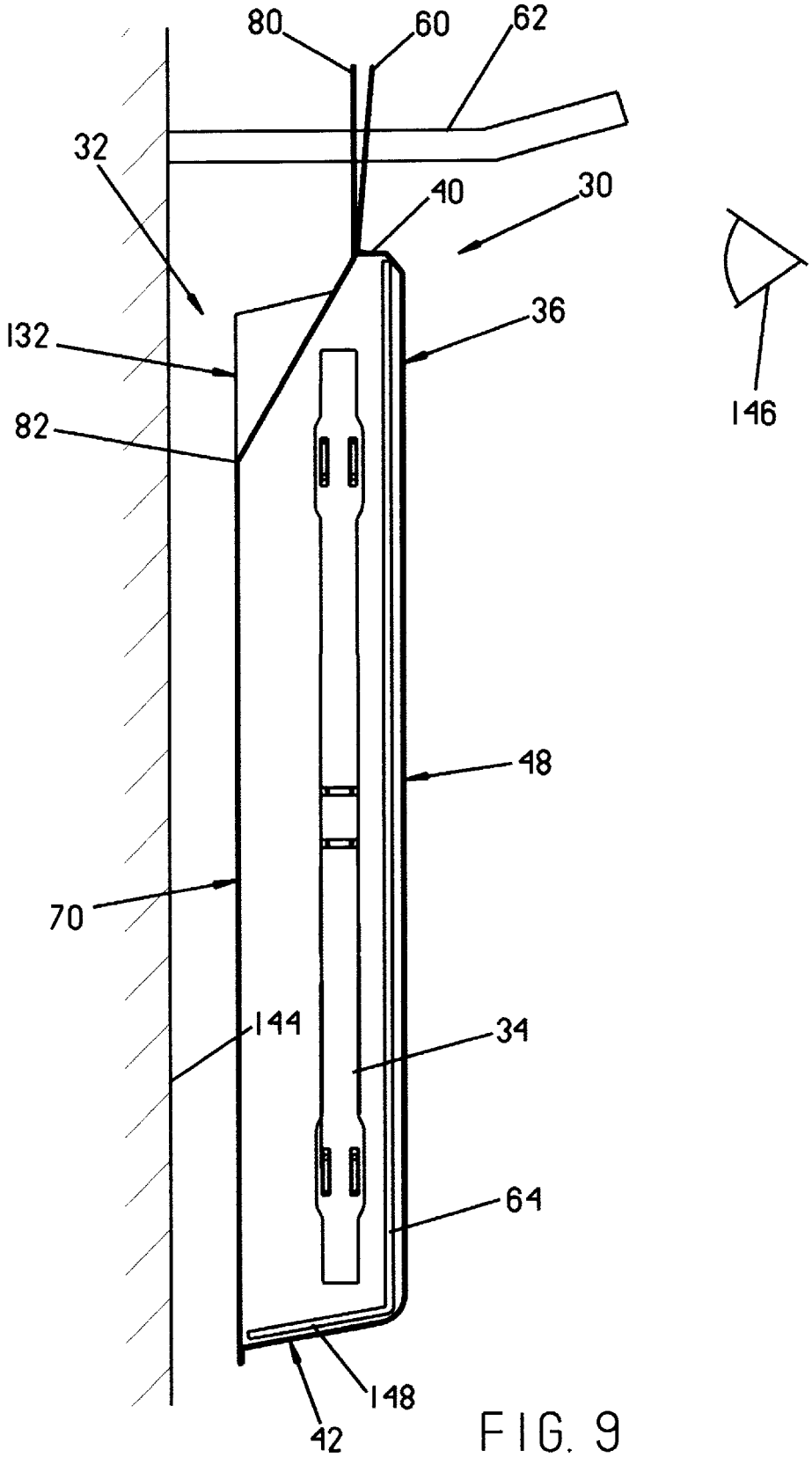
FIG. 9 is an exploded side view of the package assembly after it has been assembled.
Figure 10:
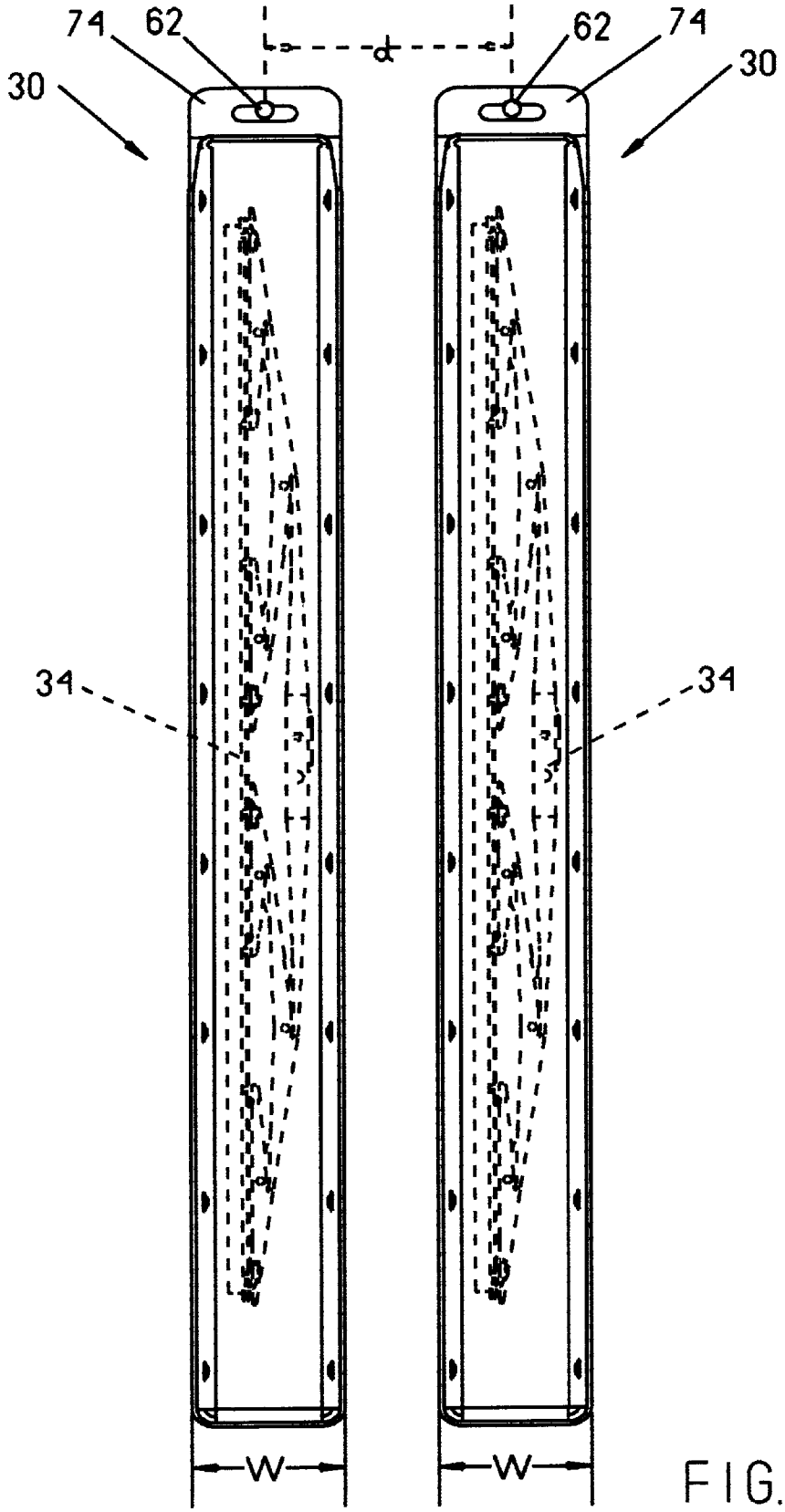
FIG. 10 depicts a pair of packages of this invention hung on spaced apart pegs of a display.

FIGS. 8–10 illustrate one preferred reclosable package assembly. Its assembly is shown in FIG. 8, a card 64 is received in the cavity 50 and disposed adjacent the outer wall 48 of package half 36. As is shown in FIG. 9, the card 64 can be constructed with a leg 148 that is disposed at an angle relative to the rest of the card 64. At least one article 34 is disposed in the cavity 50 adjacent the card 64 and the other package half 38 is placed over package half 36 with its flanges 76 in contact with the flanges 56 of package half 36. The flanges 56 and 76 are to complete the assembly of the package 30. Flanges 58, 78 and 60, 80 are not sealed or joined to permit the door 32 to be opened and closed.

In one preferred packaging application, the length, L, of the article 34 preferably is longer than the width, W (FIG. 2), of the package 30. As a result of the article length, L, being greater than package width, W, the door 32 being disposed at one end of the package 30 makes the package 30 particularly well suited for dispensing articles that are relatively long. In one preferred packaging application, the package 30 is a wiper blade package or a wiper blade refill package with the article 34 being a wiper blade or wiper blade refill that has a length, L, that is at least five times the width, W, of the package 30 and can have a length, L, that is as much as twenty times or more the width, W, of the package 30.

FIG. 9 illustrates a side view of the package 30 hung from a peg 62 of a display rack 144, such as what is commonly used in a retail store. The outer wall 48 of package half 36 is disposed toward a prospective purchaser 146 with the card 64 located between the prospective purchaser 146 and the article 34. So that the card 64, including any graphics and text on the card 64, can be viewed by a prospective purchaser 146, at least a portion of the outer wall 48 is not completely opaque and preferably is substantially clear. In a preferred package embodiment, the entire outer wall 48 is clear.

So that the prospective purchaser 146 can inspect the article 34 in the package 30, at least a portion of the outer wall 70 of package half 38 is not completely opaque and preferably is substantially clear. In a preferred package embodiment, the entire outer wall 70 is clear. As a result of being clear, a prospective purchaser 146 can place a used article he or she is seeking to replace against or adjacent the wall 70 and compare it with or against the article 34 in the package 30. If desired, the prospective purchaser 146 can use the marks 126 and labels 128 for reference to determine the length of the article 34 in the package 30 as well as to determine the length of a used article.

FIG. 10 illustrates a pair of spaced apart packages 30 that are each hung from a peg 62. The width, W, of each package 30 is such that the pegs 62 can be hung a distance, d, of about two inches apart. Where the package 30 holds wiper blades or wiper blade refills 34, the width, W, of the package 30 preferably is no greater than two inches and preferably is less than two inches. In one preferred wiper blade package embodiment, the package width, W, is about 1.850 inches from outer edge to outer edge of the package 30 thereby enabling the pegs 62 to be optimally spaced apart a distance, d, of about two inches maximizing the amount of packages 30 that can be hung from a display rack or display board and which are in view of a prospective purchaser. Consequently, retail product density is maximized which advantageously helps a retailer to maximize sales and minimize display space where nothing can be displayed.

Preferably, one or both package halves 36 and 38 are constructed of a flexible and resilient material that preferably is a plastic. In one preferred embodiment, both package halves are constructed of polyvinyl chloride ("vinyl") or polyethylene tetraglycol ("PETG"). Vinyl and PETG are particularly preferred where the package halves 36 and 38 are joined using a RF welding process.

In one package example, the package 30 is used to hold one or two windshield wiper blades or wiper blade refills 34. To accommodate wiper blades or wiper blade refills 34 as long as twenty inches, package is at least about twenty and one-half inches long from endwall 40 to endwall 42 and the package has a width, W, of less than about two inches so it can be hung on pegboard having adjacent pegs 62 spaced about an inch apart. In another preferred wiper blade package, the package 30 is about twenty-five and one-half inches in length to accommodate wiper blades and refills that can be up to twenty-four inches in length. Each package flange about the periphery preferably is at least about one-sixteenth of an inch wide and preferably is about three thirty-seconds of an inch wide. The tabs 54 and 74 each extend at least one-quarter inch from end wall 40 and preferably, both extend about three-quarters of an inch from the end wall 40. The package 30 has a depth from outer wall 70 to outer wall 48 of at least about three-eighths of an inch and preferably is about five-eighths inch deep. The length of the door 32 from the fold line 82 to its bottom edge 136 is about one inch. The width of the lip 122 from flange 80 to edge 136 is at least about one-sixteenth inches wide and preferably is about one-eighth inch wide. The width of each rib sidewall from the rib bottom wall to its adjacent flange is at least about one-sixteenth inches wide and preferably is about three-sixteenths of an inch wide. In one preferred embodiment, each package half 36 and 38 is made of clear vinyl having a thickness of no greater than about 0.050 inches.

Figure 11:
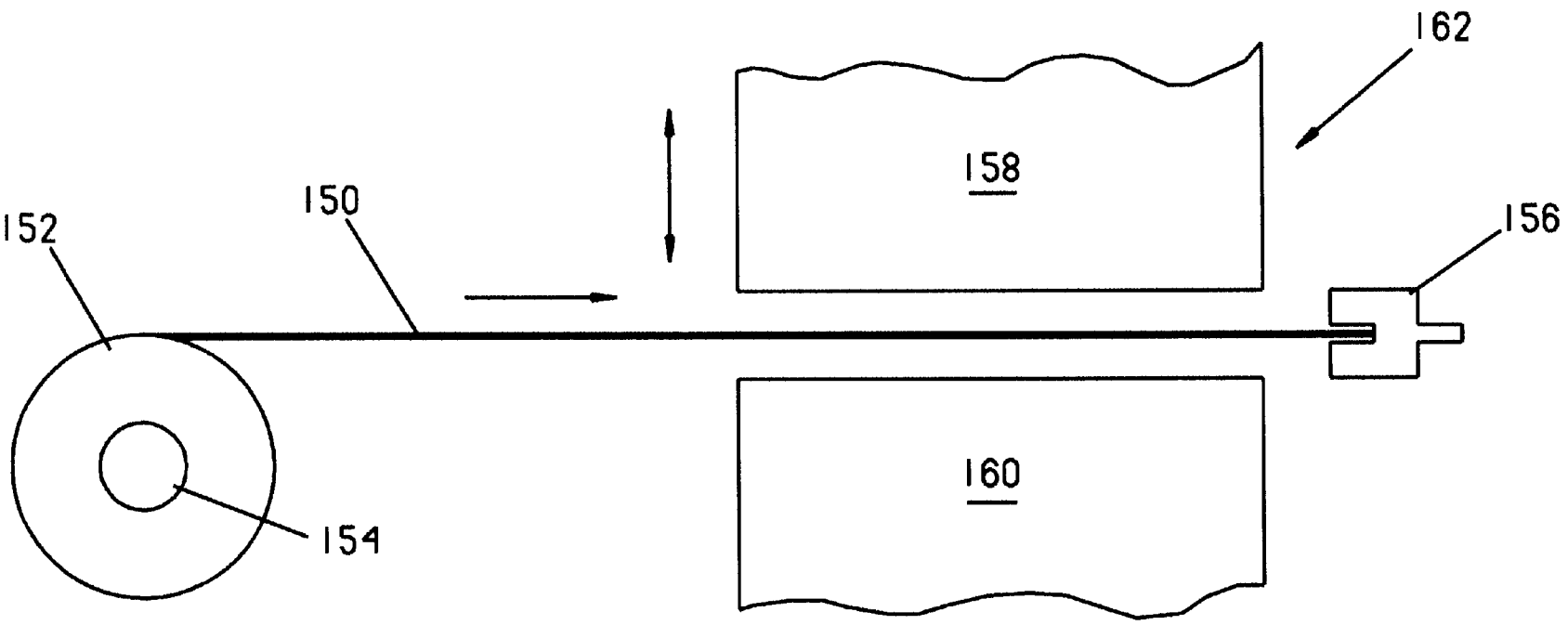
FIG. 11 is a side view of a web of material used in making a package of this invention being drawn between to dies of a thermoforming apparatus.

FIGS. 11–21 illustrate a novel method of making a package 30 of this invention having a reclosable door 32. FIG. 11 illustrates a web of material 150, such as vinyl or PETG, that is unrolled from a roll 152 carried by a mandrel 154. The web 150 is drawn by an extended pin roller chain 156 between an upper die or platen 158 and a lower die or platen 160 of a thermoforming press 162. The material of the web 150 preferably is relatively thin. For example, the material of the web 150 preferably can be as thick as about 0.050 inches or as thin as about 0.0075 inches.

In a preferred package embodiment, the cross sectional thickness of the web 150 is no greater than about 0.050 inches such that the flanges, the ribs, the outer surfaces, and sidewalls have a cross-sectional thickness no greater than about 0.050 inches. As a result of the recessed rib construction of this invention that extends about the periphery of outer surface 70, the recessed rib helps structurally rigidify the outer wall 70 and helps the package 30 resist crush. As a result, while a package 20 can have a card, such as card 64, the card is not required by either package half 36 and 38 for support and for preventing crush of the outer walls 56 and 70 toward each other. Consequently, the card 64 can be made of thinner, less expensive material. In fact, if desired, the card 64 can comprise an adhesive label applied to the interior surface of outer wall 70.

Figure 12:
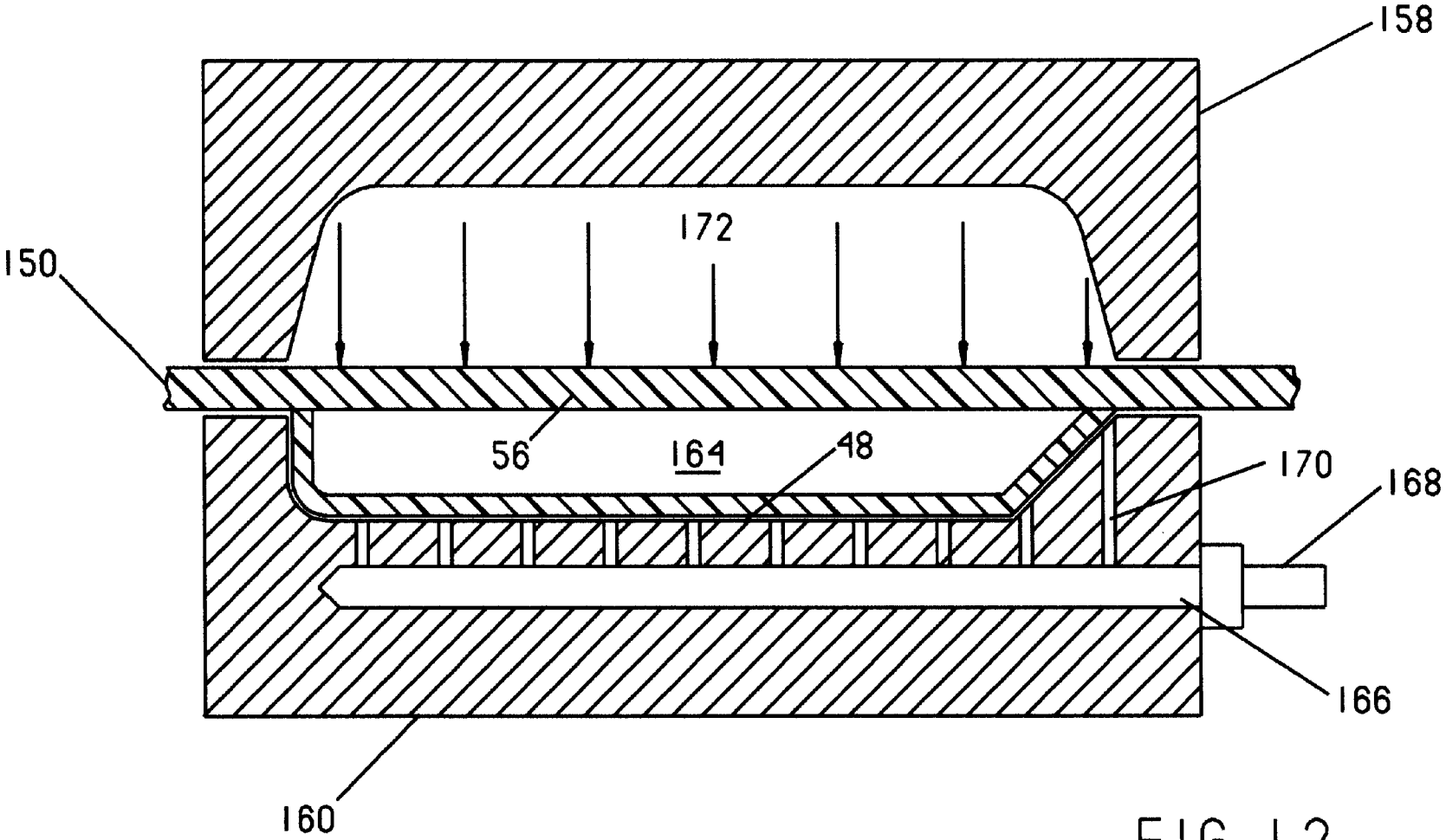
FIG. 12 is a cross-sectional side view of the apparatus thermoforming a portion of the package.

FIG. 12 illustrates thermoforming of a package half, such as package half 36 or package half 38, in the press 162. With the web 150 received between the two platens 158 and 160, one of the platens 158 is brought toward the other of the platens 160 such that each platen 158 and 160 preferably comes into contact with the web 150. Preferably, a substantially gas-tight seal is created between the platens 158, 160, and the web 150. Heat is applied to the web 150 to soften the web 150 to facilitate its forming. Where vinyl is used, the web 150 preferably is heated so it reaches a temperature of at least about 250° Fahrenheit such that the web 150 can be formed into a desired shape and the desired shape retained when at a lower temperature. A vacuum is applied to a lower die cavity 164 causing that portion of the heated web 150 overlying the cavity 164 to be drawn into the cavity 164 such that its contour substantially conforms to the three-dimensionally contoured surface of the cavity 164. The lower platen 160 has a manifold 166 connected by a line 168 to a vacuum source (not shown) that communicates the vacuum to a plurality of pairs of vacuum ports 170 that each, in turn, communicate with the cavity 164. If desired, the upper platen 158 can have a chamber 172 into which a gas, that also can be heated, is introduced to create a positive pressure that urges the web 150 into the lower die cavity 164 to help speed thermoforming. If desired, the upper platen 158 can have a portion (not shown) that protrudes from the platen 158 into the lower die cavity 164 to mechanically force a portion of the web 150 into the cavity 164 during thermoforming. After a suitable dwell time, one or both platens 158 and 160 are cooled to cool the formed web 150 to fix its shape and then one or both platens 158 and 160 are moved away from each other to permit the formed web 150 to be advanced beyond the thermoforming press 162.

Figure 13:
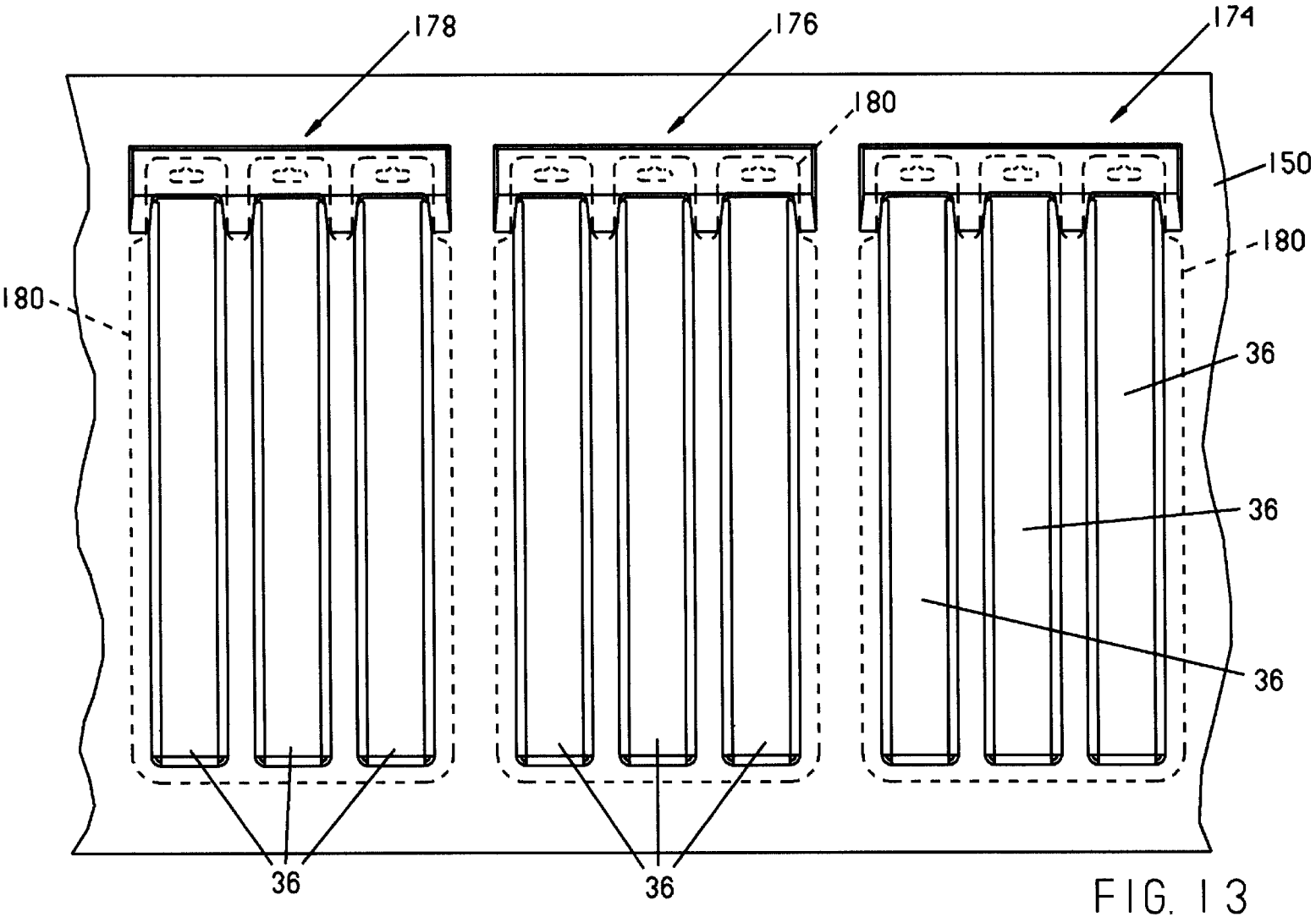
FIG. 13 illustrates a plurality of pairs of sets of thermoformed package portions with each set having a plurality of pairs of package portions.

An exemplary result of a thermoforming operation is shown in FIG. 13. FIG. 13 illustrates three sets 174, 176 and 178 of package halves 36 formed in the web 150 with each set having a plurality of pairs of package halves. The formed web 150 advances to a trim station where a trimming operation is performed to separate each set of formed halves from the web 150. Such a trim operation can be performed using a vertical trim press such as a Lyle, model 130P2-32, trim press made by Lyle Industries, Inc., of 4144 West Lyle Road, Beaverton, Mich. 48612. Where each set 174, 176 and 178 is to be trimmed is indicated by the dashed line 180 that encircles each set. The hanger hole 68 preferably is also formed during the trim operation. The trim machine preferably has a lower die that cradles the sets 174, 176 and 178 and an upper cutting die with one of the dies brought toward the other of the dies to cut each set 174, 176 and 178 along dashed line 180.

Figure 14:
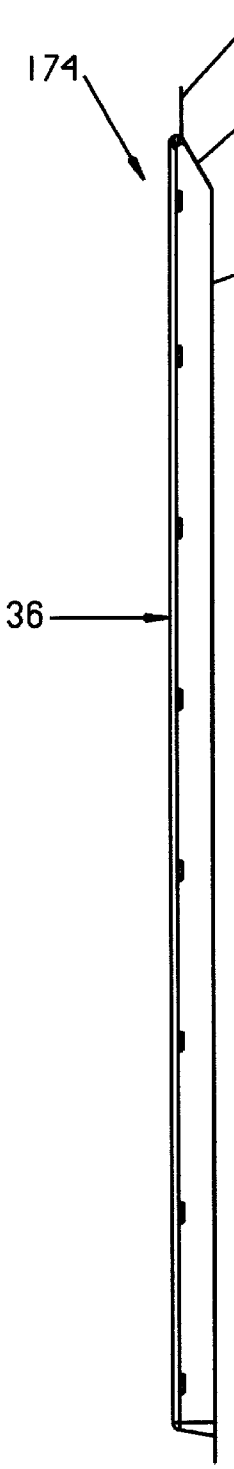
FIGS. 14 and 15 illustrate one of the sets of package portions after a trimming operation has been performed.
Figure 15:
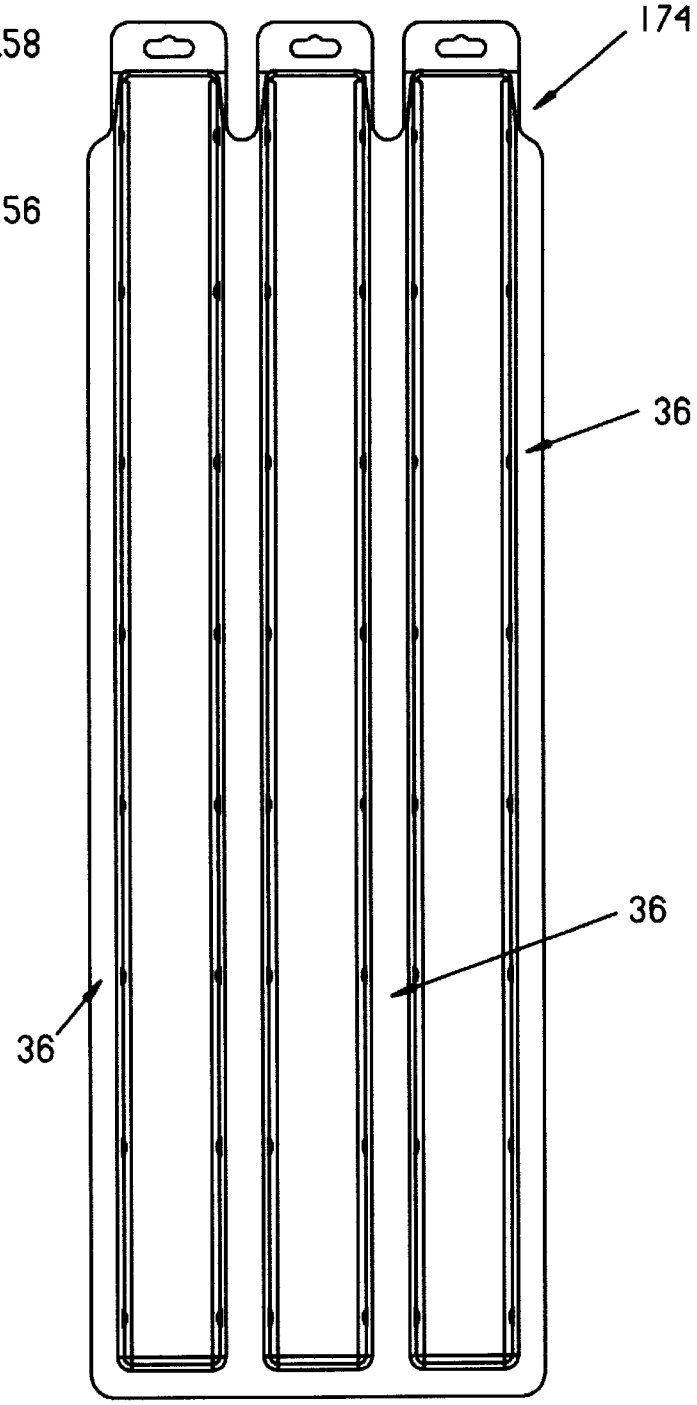

FIGS. 14 and 15 illustrates a side view of one of the package sets 174 after the trim operation is completed. As is best shown by FIG. 14, the trim operation is performed along the flanges 56, 58 and 60 of the package halves 36 of the set 174 and is a multilevel trim operation because the trim must be performed along more than one trim plane. More specifically, a first trim plane is located along flange 56 and a second trim plane is located along flange 58.

Each trimmed set can be stacked in another set and stored to await final assembly, if desired. If desired, a plurality of pairs of trimmed sets can be stacked and shipped for final assembly at another location.

Figure 16:
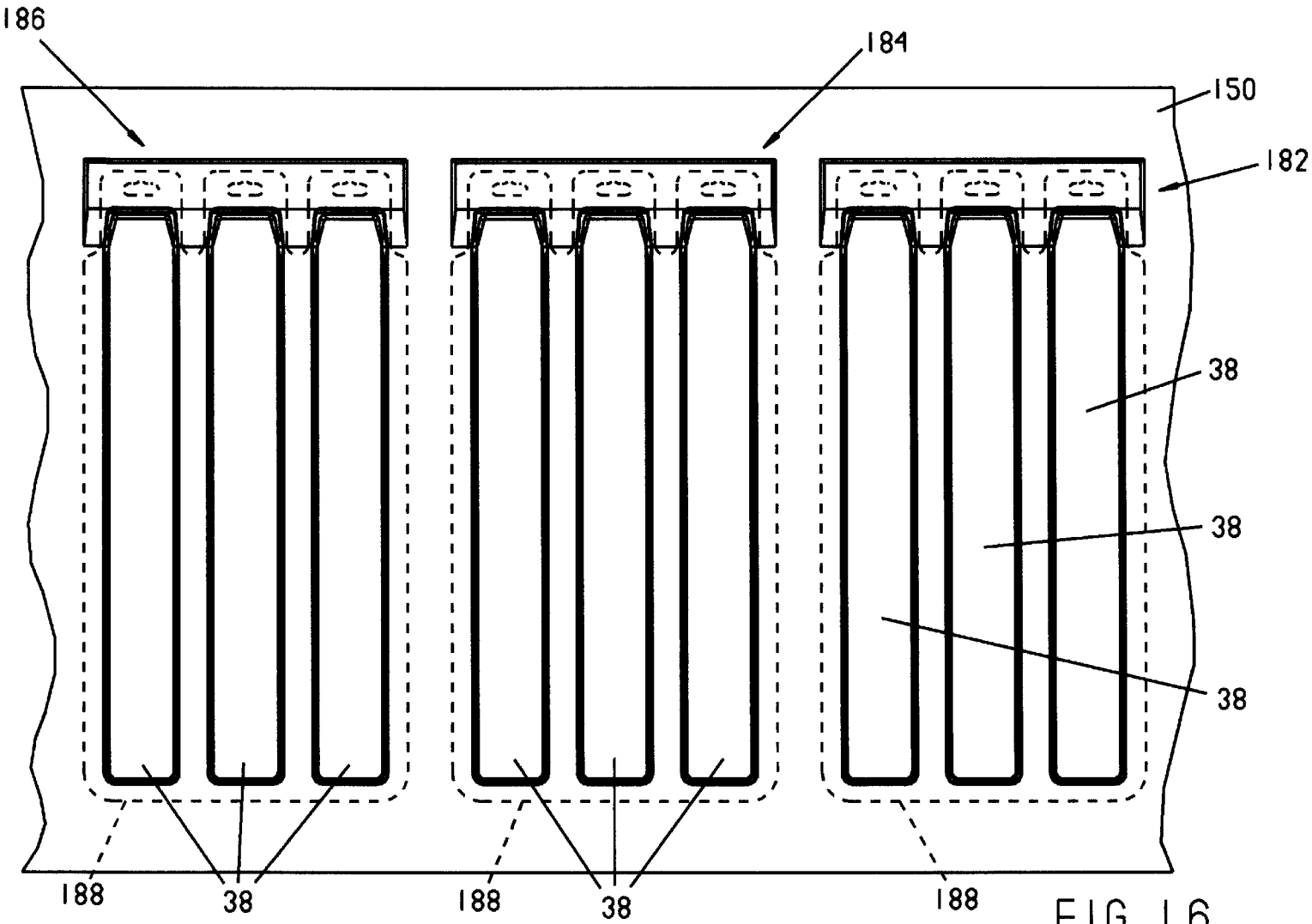
FIG. 16 illustrates a plurality of pairs of sets of another of the thermoformed package portions with each set having a plurality of pairs of package portions.
Figures 17, 18:
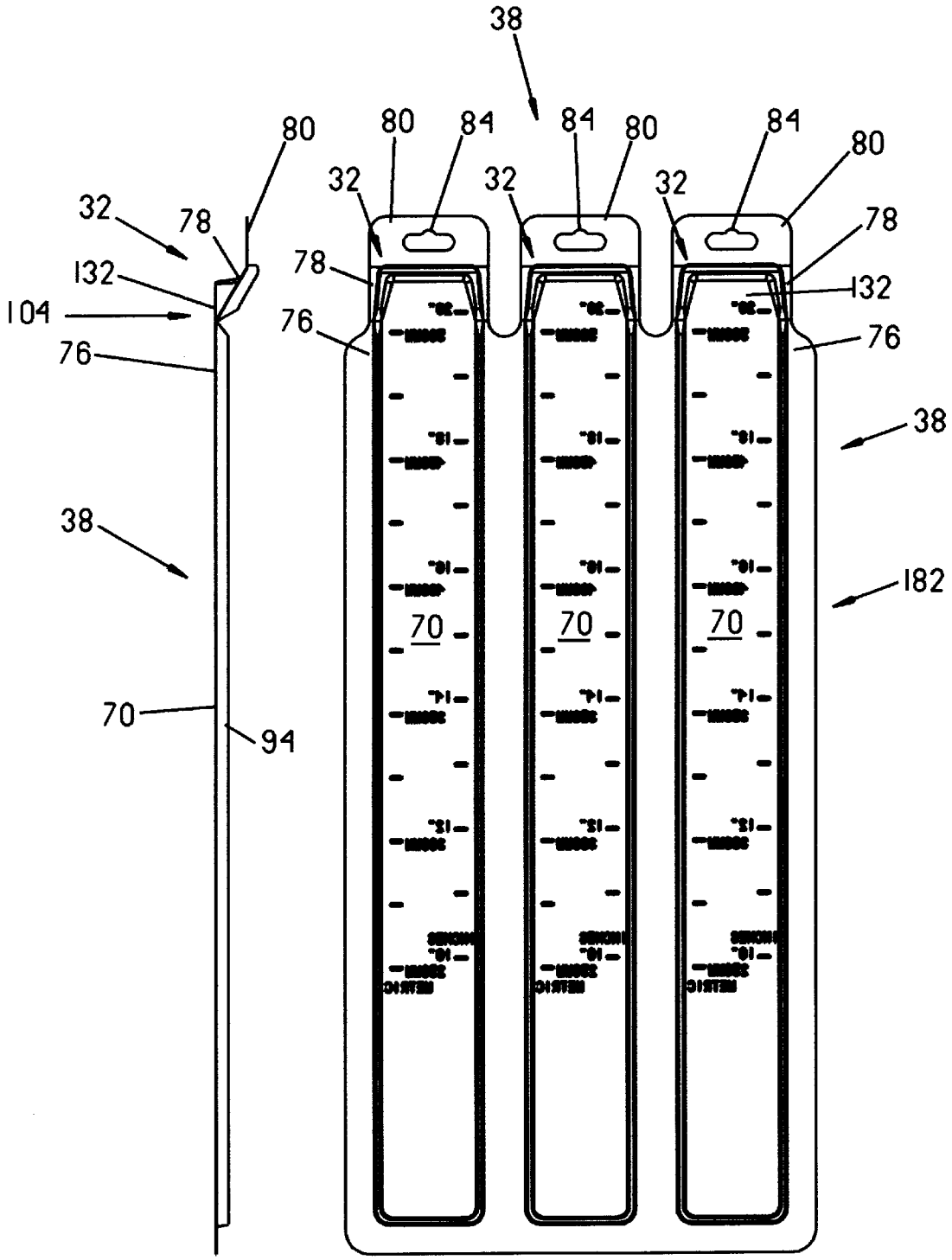
FIGS. 17 and 18 illustrate one of the sets of the package portions after a trimming operation has been performed.
Figure 19:
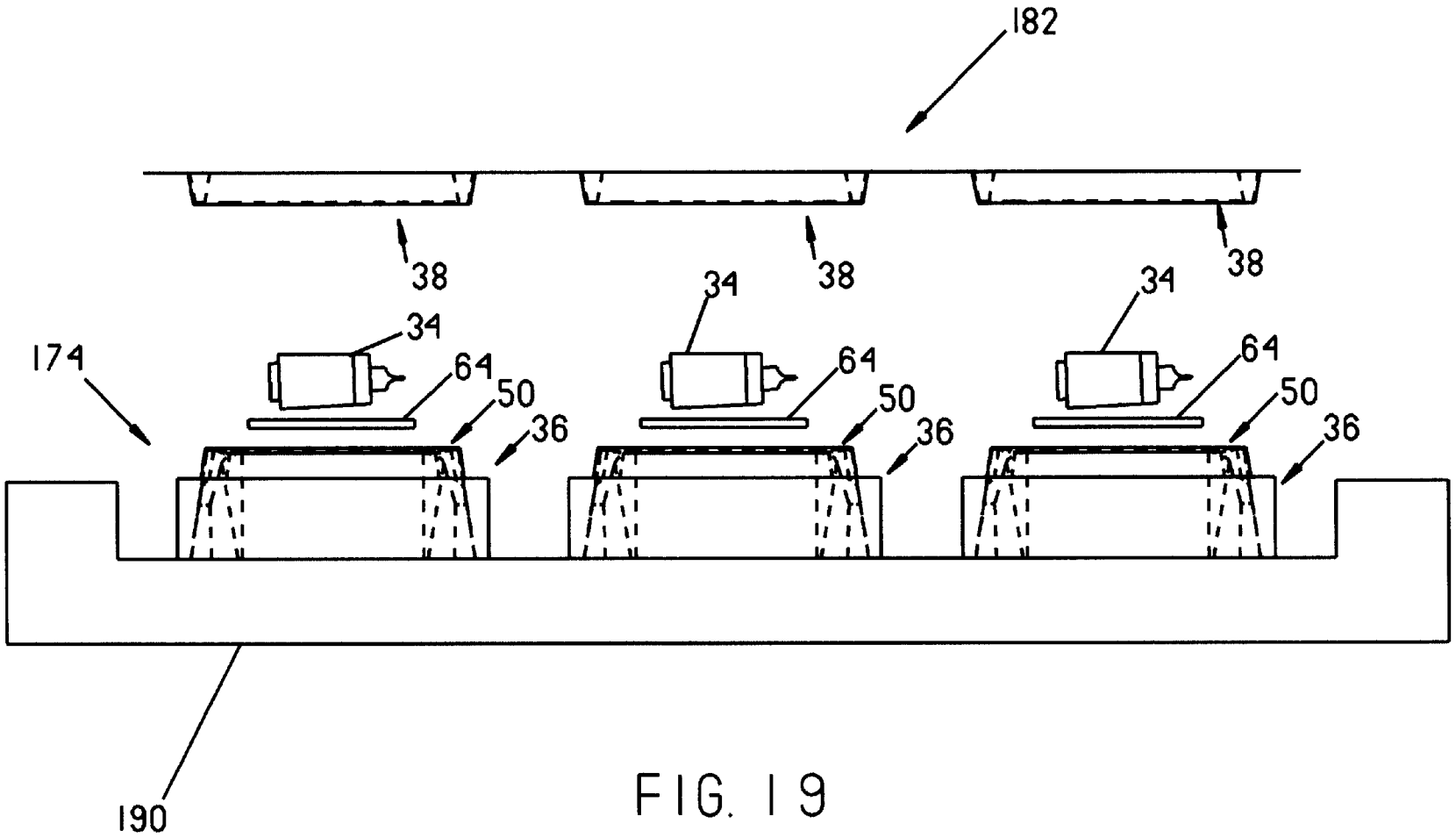
FIG. 19 illustrates loading cards and articles into the package portions of one set and assembling one set of package portions to another set of package portions.

Another web 150 containing three sets 182, 184 and 186 of formed package halves 38 is shown in FIG. 16. In a like manner, as done with the sets 174, 176, and 178 of formed package halves 36, a multilevel trim operation is performed to cut each set 182, 184 and 186 along dashed line 188 such that when the trim operation is finished, each set appears generally as shown in FIGS. 17 and 18. As is illustrated in FIG. 17, the trim operation preferably can be a multilevel trim operation because the flanges 76, 78 and 80 being trimmed can lie in different planes.

In the preferred embodiment, the flange 78 of the door 32 and the flange 76 of the remainder of the body of the package half 38 lie in different planes. Such a multilevel trim operation is critical to enabling a reclosable door 32 to be formed at one end of the package 30 as it facilitates location of the notch 113 and 115 between the longitudinal ribs 92, 106 and 94, 108 and permits layout of the door 32 such that the outer surface 132 of its upraised portion 104 is an extension of wall 70 and can lie in the same plane as wall 70.

FIGS. 18–22 illustrates a method of assembling a pair of sets 174 and 182 of package halves 36 and 38 to form three of the packages 30. One of the sets, in this case, set 174, is located and cradled in a lower fixture 190. A card 64 is placed in each cavity 50 of each package half 36. An article 34 is thereafter placed in each cavity 50 of each package half 36 on top of the card 64. If desired, the packages 30 can be assembled without any card 64. After the articles 34 have been loaded, the other of the sets, in this case, set 182, is brought over set 174 and brought toward set 174. Preferably, set 182 is carried by an upper fixture 192 (FIG. 20) using suction.

The sets 174 and 182 are brought together such that the ribs 92, 94, 96, 106,108, and 110 of each package half 38 are disposed interiorly of the sidewalls of a respective package half 36 helping to locate the package halves 38 relative to the package halves 36 such that they fit together properly. The sets 174 and 182 are brought together until flanges 56 and 76 overlap and bear against each other. Preferably, flanges 58 and 78 also overlap and bear against each other.

Figure 20:
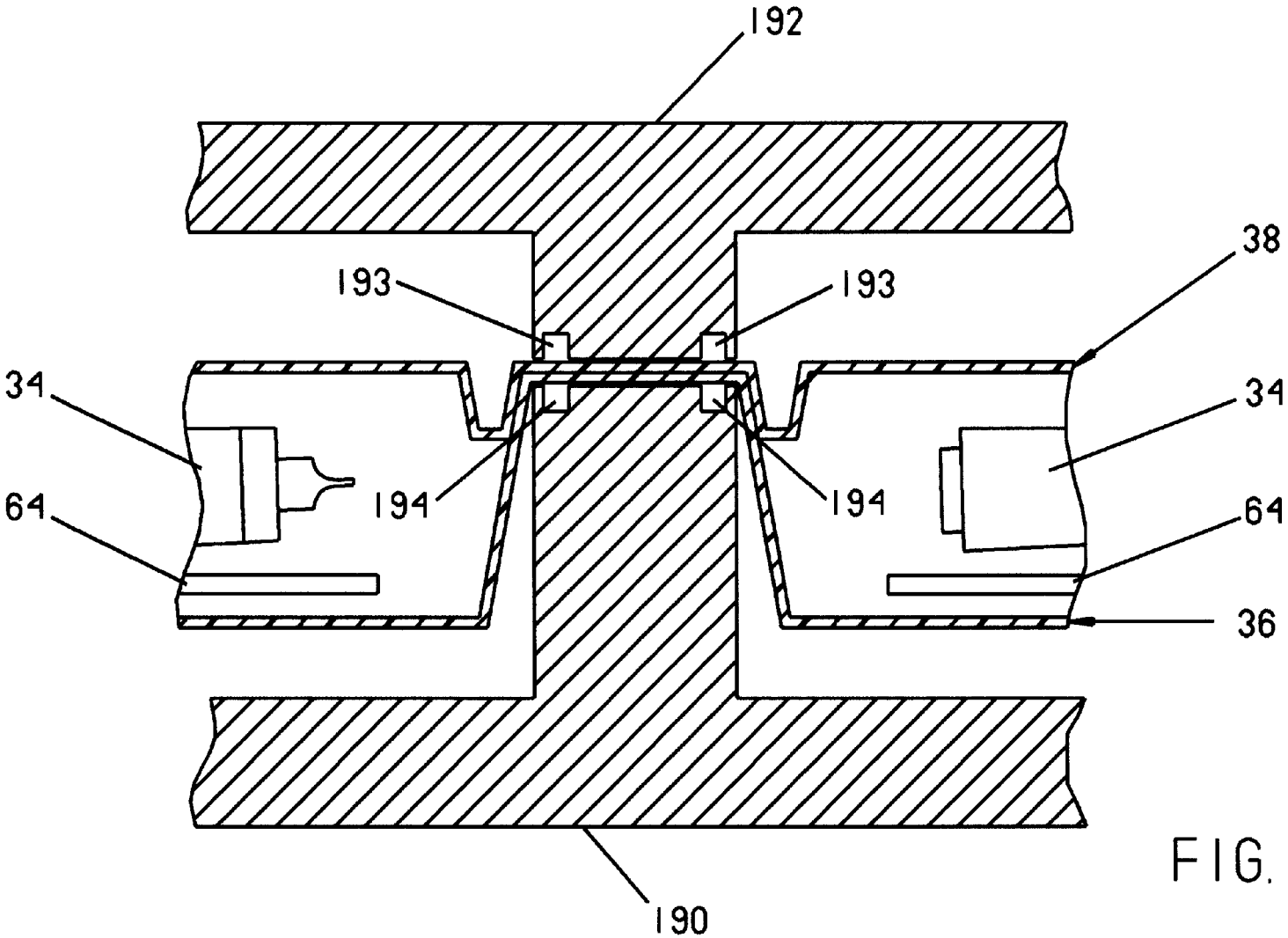
FIGS. 20 and 21 illustrates joining one set to another set to form three packages.
Figure 21:
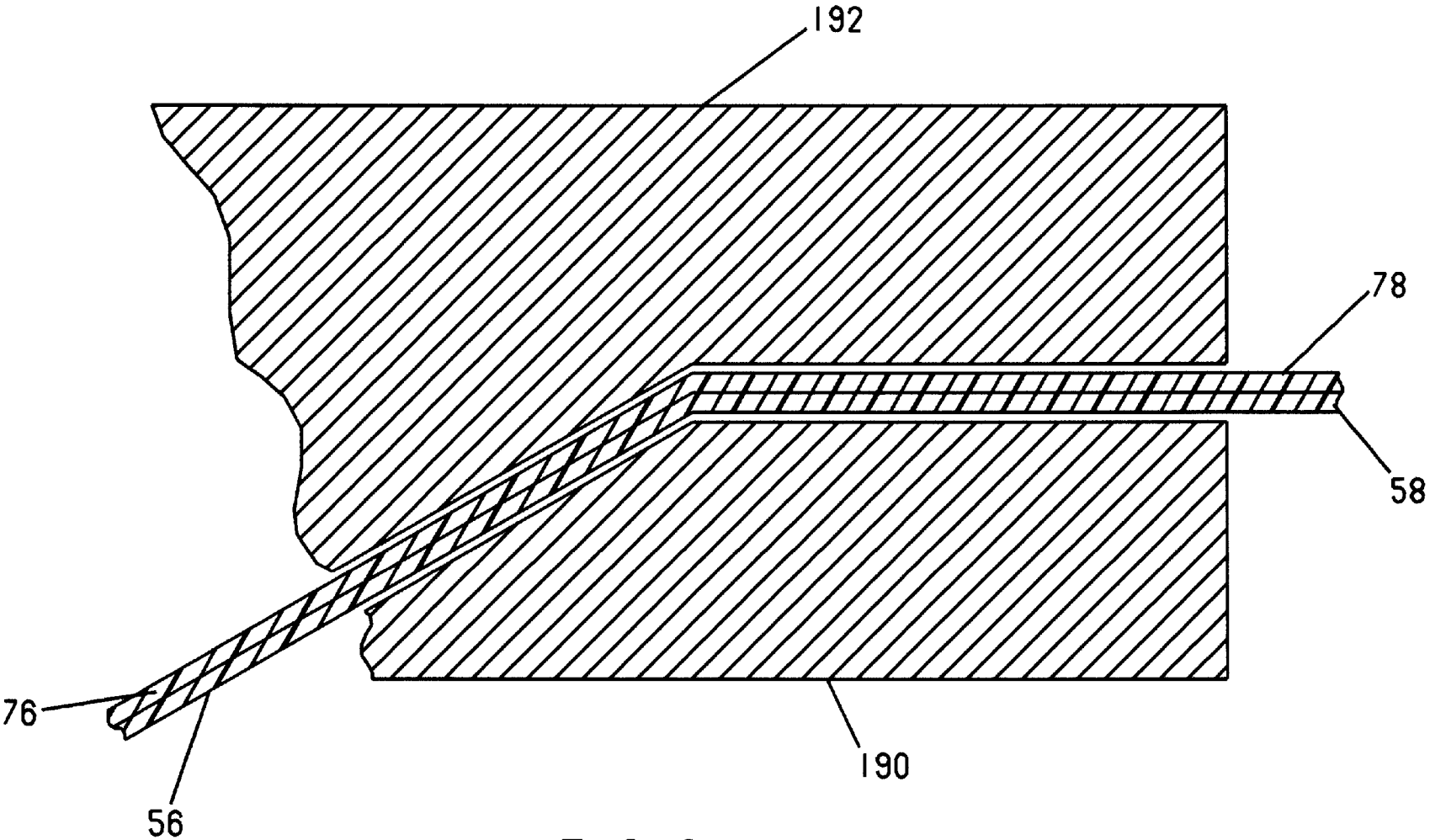
Figure 22:
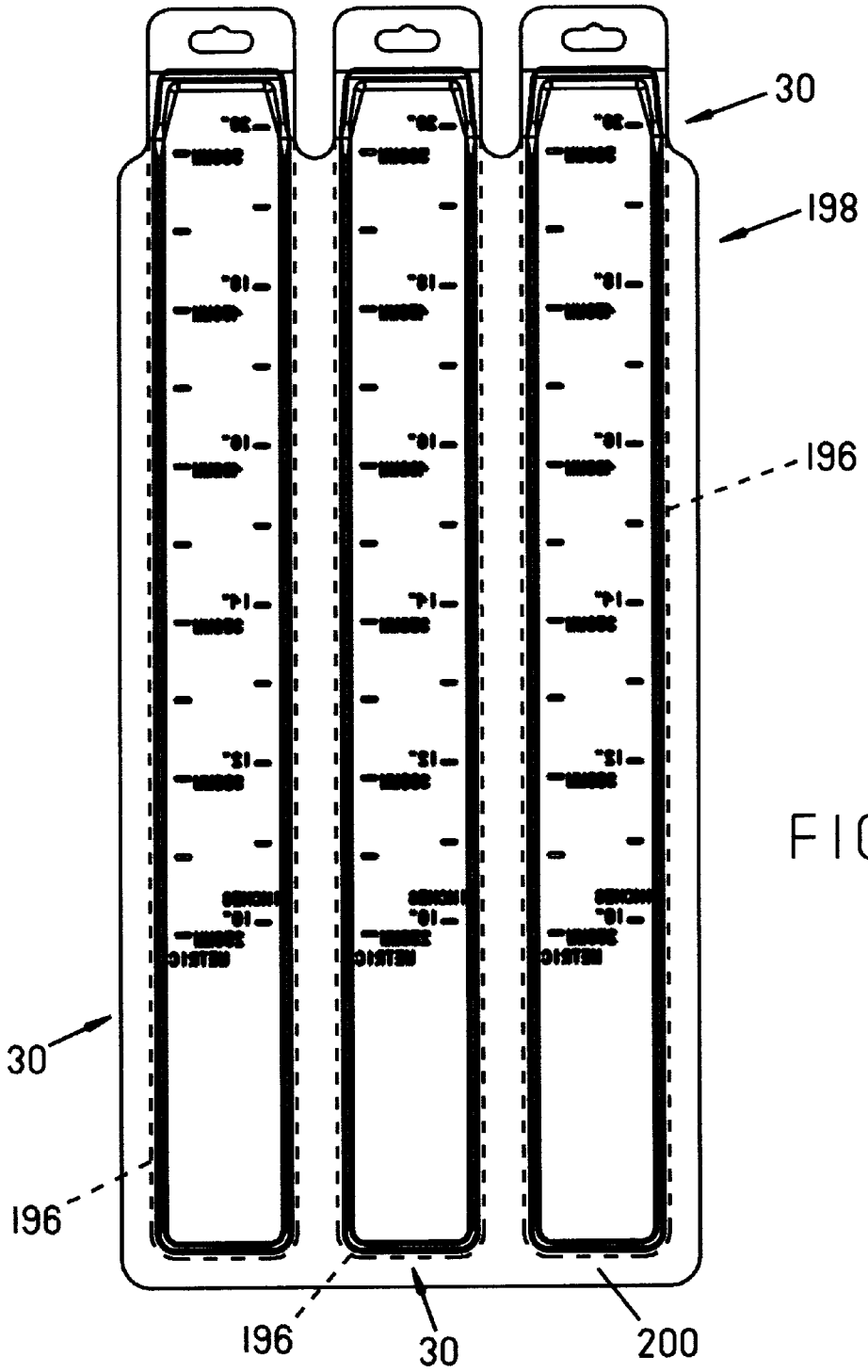
FIG. 22 illustrates a tear seal or tear weld joining the sets together to form the three packages.

Thereafter, as is shown in FIGS. 20 and 21, the fixtures 190 and 192 are brought together and energy is radiated from a portion of one or both fixtures generally in the regions identified by reference numerals 193 and 194 to heat flanges 56 and 76 such that at least a portion of flange 56 fuses with a portion of flange 76, joining them together. As is shown in FIG. 21, the fixtures 190 and 192 are constructed such that flanges 58 and 78 adjacent the door 32 are not sealed or otherwise joined to permit the door 32 to be opened and closed. If desired, because of the previously described trimming operation, the fixtures 190 and 192 need not overlie flanges 58 and 78.

A dashed line 196 indicates where the flanges 56 and 76 are fused or sealed together. Preferably, the process used to fuse the flanges 56 and 76 is a RF welding process that creates a relatively narrow seam at line 196. Preferably the seam 196 is a tear-type seam that can produce a flange no wider than about ⅛ of an inch and preferably no wider than about 3⁄32 of an inch such that the RF welding process advantageously minimizes the width of the flanges 56 and 76 enabling the total package width, W, to be desirably minimized. By using this joining or welding process, the usable volume inside the article receiving cavity 50, in which one or more articles 34 can be retained, is also maximized as the width of the cavity 50 advantageously approaches the total package width, W. Because of minimizing package width, W, while maximizing the useable volume of the article-receiving cavity 50, the density of the packages 30 in a retail display space can also advantageously be maximized.

When the sealing operation is completed, the fixtures 190 and 192 are spread apart and a set 198 of three fused packages 30 is removed. An automatic or manual tearing operation is performed to separate each of the packages 30 from the other of the packages 30 along the tear seam 196. After the scrap 200 has been removed, three completed packages 30 (FIG. 1) of this invention are formed.

It is also to be understood that, although the foregoing description and drawings describe and illustrate in detail at least one preferred embodiment of the present invention and at least one method for making a preferred embodiment, to those skilled in the art to which the present invention relates, the present disclosure will suggest many modifications and constructions as well as widely differing embodiments and applications without thereby departing from the spirit and scope of the invention. The present invention, therefore, is intended to be limited only by the scope of the appended claims.

What is claimed is:

1. A reclosable package comprising:

a pair of spaced apart surfaces that overlie each other and define an enclosure;

an article received in the enclosure;

wherein one of the surfaces has a door that has a closed position and an open position disposed away from the closed position;

wherein one of the surfaces comprises a) a first pair of substantially coplanar, spaced apart, outer peripheral flanges that are each disposed generally longitudinally relative to the reclosable package and which are disposed substantially parallel to a first plane, and b) a second pair of substantially coplanar, spaced apart outer peripheral flanges that are each disposed generally longitudinally relative to the reclosable package and which are disposed substantially parallel to a second plane;

wherein the other of the surfaces comprises a) a third pair of substantially coplanar, spaced apart, outer peripheral flanges that are each disposed generally longitudinally relative to the reclosable package and which are disposed substantially parallel to the first plane, and b) a fourth pair of substantially coplanar, spaced apart outer peripheral flanges that are each disposed generally longitudinally relative to the reclosable package and which are disposed substantially parallel to the second plane when the door is disposed in the closed position;

wherein the first plane is disposed at an angle relative to the second plane;

at least one seal joins at least a portion of each one of the flanges of the first pair of flanges to one of the flanges of the third pair of flanges;

wherein each one of the flanges of the second pair of flanges overlies one of the flanges of the fourth pair of flanges; and wherein the flanges of the second pair of flanges are not attached to the flanges of the fourth pair of flanges 1) permitting the door to be moved between the closed position and an open position, and 2) enabling an article to be dispensed out one end of the enclosure when the door is disposed in an open position.

2. A reclosable package according to claim 1 wherein the reclosable package has a maximum width and the length of the article is longer than the maximum width of the reclosable package.

3. A reclosable package according to claim 2 wherein the door bends along a generally transversely-extending fold line when being moved toward an open position and further comprising a generally longitudinally-extending rib that extends across the fold line and a generally transversely-extending rib that extends across the generally longitudinally-extending rib that creates a region of weakness in the generally longitudinally-extending rib that causes the door to bend along the fold line when being moved toward an open position.

4. A reclosable package according to claim 3 wherein the generally transversely extending rib forms a notch in the generally-longitudinally extending rib that creates the region of weakness.

5. A reclosable package according to claim 1 further comprising a rib adjacent and around but inboard of the outer peripheral flanges of the surface having the door wherein the rib has two longitudinally-extending rib sections with each of the longitudinally-extending rib sections having a notch that creates a region of weakness in each of the longitudinally-extending rib sections that forms a living hinge in the surface having the door that enables the door to be pivoted about the living hinge toward and away from its closed position.

6. A reclosable package according to claim 1 further comprising (a) a pair of spaced apart sidewalls between the surfaces defining a package having a generally rectangular cross section, and (b) an integrally formed rib about the periphery of the surface having the door wherein the integrally formed rib has two longitudinally-extending rib sections with each of the longitudinally-extending rib sections having a notch that creates a region of weakness in each of the longitudinally-extending rib sections that forms an integral hinge in the surface having the door that enables the door to be pivoted about the integral hinge toward and away from its closed position.

7. A package according to claim 1 wherein one of the surfaces have a tab with a hole and the other of the surfaces have a tab with a hole wherein, when the package is hung from a peg that extends through each hole in each tab, movement of the door away from the closed position is opposed when the door is located in the closed position.

8. A reclosable package according to claim 6 wherein one of the surfaces has an endwall adjacent the door and the door further comprises a lip that engages the endwall when the door is located in the closed position releasably retaining the door in the closed position.

9. A reclosable package according to claim 8 wherein there is an interference fit between the lip of the door and the endwall when the door is disposed in the closed position.

10. A reclosable package according to claim 5 wherein the notch in each longitudinally-extending rib section comprises a hinge rib that extends generally transversely to the longitudinally-extending rib section and generally defines a fold line along which a portion of the door bends when moved away from the closed position.

11. A reclosable package according to claim 10 wherein the hinge rib has a generally triangular cross section.

12. A package according to claim 6 wherein each of the surfaces, the flanges and the rib is comprised of plastic having a cross-sectional thickness of at least 0.0075 inches and no greater than 0.050 inches.

13. A reclosable package according to claim 12 wherein one of the surfaces further comprises a pair of generally longitudinally extending spaced apart sidewalls that carry two pairs of the flanges, and the surfaces and the sidewalls are self-supporting such that no card is required for support.

14. A reclosable package according to claim 12 wherein the seal comprises a RF weld that forms a tear seal.

15. A reclosable package according to claim 1 wherein one of the surfaces comprises a backing body that is formed of thin flexible thermoformed material and has a recessed rib adjacent and around but inboard of its periphery to stiffen the backing body;

another of the surfaces is formed of thin flexible thermoformed material and is three dimensionally contoured so as to define a bubble body that is mounted to the backing body with the bubble body three dimensionally contoured so as to form a cavity therein for receiving an article therein; and the backing body has a first outer wall section attached by an integral hinge to a second outer wall section that forms the door that releasably engages the bubble body when the door is disposed in the closed position and which permits an article to be withdrawn from the reclosable package in a direction generally parallel to the lengthwise direction of the reclosable package when the door is moved away from the closed position.

16. A reclosable package according to claim 15 wherein the package has a width and the article comprises a windshield wiper blade- or a windshield wiper blade refill having a length that is at least twice as long as the width of the package.

17. A reclosable package according to claim 15 wherein each of the surfaces has a cross-sectional thickness of no greater than about 0.050 inches.

18. A reclosable package according to claim 1 wherein the package has a cavity in which the article is received and further comprising a plurality of pairs of opposed fingers that extend inwardly from one of the surfaces into the cavity and a card received in the cavity that is retained against one of the surfaces by the fingers.

19. A reclosable package according to claim 1 wherein the package has a cavity in which the article is received, one of the surfaces is substantially clear such that a prospective purchaser can see through it, and another of the surfaces is substantially clear such that a prospective purchaser can see through it, and further comprising a tab that has a hole through which a peg can be received for hanging the package, a card received in the cavity and disposed adjacent one of the surfaces, and wherein when the package is hung from a peg, the card is disposed between the prospective purchaser and an article received in the cavity.

20. A reclosable package according to claim 19 wherein one of the surfaces has a plurality of pairs of spaced apart marks integrally molded thereinto such that the length of an article can be estimated.

21. A reclosable display package comprising:

a bubble body formed of a flexible thermoformed material having an outer wall, pair of spaced apart sidewalls extending from the outer wall, a pair of spaced apart endwalls extending from the outer wall, all of which define an article-receiving cavity, and a peripheral flange for sealing to a backing body;

a backing body formed of a thin flexible thermoformed material having a pair of spaced apart sides, a pair of spaced apart ends, a recessed rib about its periphery, a flange section about a portion of each side and one of the ends that is sealed to the peripheral flange of the bubble body, a door at an opposite end, and a hinge rib formed generally transversely in the recessed rib that generally defines a fold line about which the door bends when being moved between a closed position where the door engages one of the endwalls and a position disposed from the closed position where the door is disengaged from the one of the endwalls.

22. A reclosable package according to claim 21 wherein the flange section comprises a first flange section that is substantially planar and further comprising a second flange section that is substantially planar and disposed at an acute angle relative to the first flange section when the door is in the closed position wherein the second flange section extends from a portion of each of the sides of the backing body adjacent the door and about an end adjacent the door.

23. A reclosable package according to claim 21 wherein the hinge rib is disposed adjacent where the first flange section and second flange section meet.

24. A method of making a reclosable package comprising:

(a) providing a first sheet of a thermoformable and energy weldable material and a second sheet of a thermoformable and energy weldable material;

(b) thermoforming the first sheet into a bubble body having an article-receiving cavity with an outer wall, a pair of spaced apart integrally formed sidewalls, a pair of spaced apart integrally formed endwalls, and an integrally formed peripheral flange having a first flange section disposed about a portion of each of the sidewalls and a second flange section disposed about a remaining portion of each of the sidewalls with the second flange section disposed at an angle relative to the first flange section;

(c) thermoforming the second sheet into a backing body having an outer wall, an integrally thermoformed door at one end, an integrally thermoformed peripheral flange and an integrally thermoformed rib about the periphery that is disposed inboard of the peripheral flange with the peripheral flange having a first flange section disposed along a portion of each of the sidewalls and a second flange section about the door that is disposed along a remaining portion of each of the sidewalls, and the recessed rib having a pair of longitudinally extending sections and a pair of transversely extending rib sections with each of the longitudinally extending rib sections divided by a hinge rib into a first longitudinally extending rib portion and a second longitudinally extending rib portion such that when the door is bent relative to the first flange section a fold line extends from one of the hinge ribs to the other of the hinge ribs;

(d) trimming the first sheet in a multilevel trim operation such that the first flange section and the second flange section are trimmed substantially simultaneously with the first flange section disposed in one plane and the second flange section disposed in another plane during trimming;

(e) trimming the second sheet such that the first flange section and the second flange section are trimmed substantially simultaneously;

(f) overlapping the first sheet with the second sheet such that the first flange section of the first sheet is in contact with the first flange section of the second sheet; and (g) sealing the first flange section of the first sheet to the first flange section of the second sheet using an energy welding process.

25. A method according to claim 24 wherein during step (e) the first flange section and the second flange section are trimmed in a multilevel trim operation.

26. A method according to claim 25 during step (b) a plurality of pairs of spaced apart and opposed fingers that extend into the article receiving cavity are molded into the sidewalls and before step (g) the additional step of placing a card into the article-receiving cavity against the outer wall with the card being retained in the article receiving cavity by the fingers.

27. A method according to claim 26 wherein the article has a length longer than the package width and is placed in the article-receiving cavity before step (g).

28. A method according to claim 24 wherein a portion of the second flange section of both the first sheet and the second sheet are trimmed during steps (d) and (e) such that a hanger hole is formed in each of the second flange sections adjacent the door.

29. A method according to claim 24 wherein during step (g) RF welding is performed.

30. A method of according to claim 29 wherein during step (g) RF welding forms a tear seam about at least a portion of the periphery of the package.

31. A method according to claim 30 wherein after step (g) the further step of removing excess flange material along the tear seam.

32. A method according to claim 31 wherein after excess flange material is removed, a finished flange about the periphery of the package is produced having a width of no greater than about 3/32 of an inch at least adjacent the tear seam.

33. A method according to claim 32 wherein the width of the finished flange about the periphery of the package extends from the rib to an outer peripheral edge of the finished flange.

34. A method according to claim 24 the further step comprising loading the article after trimming is performed in steps (d) and (e) and before sealing is performed in step (g).

35. A method according to claim 24 wherein the first sheet and the second sheet have a cross-sectional thickness of no greater than 0.050 inches, the integrally formed rib is a recessed rib, and steps (b), (c), (d), (f), and (g) are performed in the order recited.

36. A package comprising:

(a) a pair of surfaces that overlie each other and that are spaced apart to define an enclosure with one of the surfaces carrying a door that is disposed adjacent one end of the enclosure which 1) has a closed position that retains in the enclosure an article received in the enclosure, 2) has an open position disposed away from the closed position that permits an article received in the enclosure to be removed from the enclosure, and 3) bends along a generally transversely-extending fold line when being moved from the closed position toward an open position;

(b) a pair of spaced apart and opposed sidewalls disposed between the surfaces such that the enclosure is tubular;

(c) a generally longitudinally-extending rib formed in the one of the surfaces carrying the door, the generally longitudinally-extending rib extending across the fold line;

(d) a generally transversely-extending rib formed in the generally longitudinally-extending rib that creates a region of weakness in the generally longitudinally-extending rib and defines the general location of the fold line;

(e) wherein the package has a maximum width and the length of the article received in the enclosure is longer than the maximum width of the package; and (f) wherein the door has a length less than a third of the length of the package.

37. A package according to claim 36 wherein:

1) one of the surfaces comprises i) a first pair of substantially coplanar spaced apart and generally longitudinally extending outer peripheral flanges disposed substantially parallel to a first plane, and ii) a second pair of substantially coplanar spaced apart and longitudinally extending outer peripheral flanges disposed substantially parallel to a second plane;

2) another of the surfaces comprises i) a third pair of substantially coplanar spaced apart and generally longitudinally extending outer peripheral flanges disposed substantially parallel to the first plane, and ii) a fourth pair of substantially coplanar spaced apart and generally longitudinally extending outer peripheral flanges disposed substantially parallel to the second plane when the door is disposed in the closed position;

3) the first plane is disposed at an angle relative to the second plane;

4) at least one seal joins at least a portion of each one of the flanges of the first pair of flanges to one of the flanges of the third pair of flanges;

5) each one of the flanges of the second pair of flanges overlies one of the flanges of the fourth pair of flanges; and 6) the flanges of the second pair of flanges are not attached to the flanges of the fourth pair of flanges and define the door.

38. A package according to claim 37 wherein:

the door that is carried by one of the surfaces comprises a lip that engages an upraised wall of the another one of the surfaces when the door is disposed in the closed position;

each of the surfaces, including the outer peripheral flanges of each the surfaces, have a thickness no greater than 0.050 inches; and each flange of the first pair of the flanges and each flange of the third pair of flanges is straight and has a width no greater than 3/32 of an inch.

39. A package according to claim 38 wherein the transversely-extending rib is comprised of a first surface that is disposed at an angle relative to a second surface that is between about 80° and about 90° when the door is disposed in the closed position.

40. A package according to claim 38 further comprising an interference fit between the lip and the upraised wall of the another one of the surfaces wherein the door is retained in the closed position when the door is disposed in the closed position.

41. A package according to claim 40 wherein the upraised wall comprises a first endwall disposed adjacent one end of the enclosure and further comprising another endwall disposed adjacent an opposite end of the enclosure that has a width in a direction transverse to its lengthwise direction that is wider than a width of the first endwall in a direction transverse to its lengthwise direction.

42. A package according to claim 40 wherein interference fit comprises a snap fit.

43. A package according to claim 37 wherein the first plane is disposed at an angle, β, relative to the second plane of between 20° and 45°.

44. A reclosable package comprising:

a pair of spaced apart surfaces that define an enclosure with one of the surfaces having a door that has a closed position where the door overlies an access opening and an open position disposed away from the closed position such that the access opening is exposed such that an article in the package can be removed from the package; and a recessed rib about the periphery of the surface having the door wherein the recessed rib has two longitudinally-extending rib sections with each of the longitudinally-extending rib sections having a notch that creates a region of weakness in each of the longitudinally-extending rib sections along which the door folds when moved away from the closed position.

45. A reclosable package according to claim 44 wherein:

1) one of the surfaces comprises i) a first pair of substantially coplanar spaced apart and generally longitudinally extending outer peripheral flanges disposed substantially parallel to a first plane, and ii) a second pair of substantially coplanar spaced apart and longitudinally extending outer peripheral flanges disposed substantially parallel to a second plane;

2) another of the surfaces comprises i) a third pair of substantially coplanar spaced apart and generally longitudinally extending outer peripheral flanges disposed substantially parallel to the first plane, and ii) a fourth pair of substantially coplanar spaced apart and generally longitudinally extending outer peripheral flanges disposed substantially parallel to the second plane when the door is disposed in the closed position;

3) the first plane is disposed at an angle relative to the second plane;

4) at least one seal joins at least a portion of each one of the flanges of the first pair of flanges to one of the flanges of the third pair of flanges;

5) each one of the flanges of the second pair of flanges overlies one of the flanges of the fourth pair of flanges; and 6) the flanges of the second pair of flanges are not attached to the flanges of the fourth pair of flanges and define the door.

46. A reclosable package according to claim 45 wherein each flange of the first pair of the flanges and each flange of the third pair of flanges has a width of at least 1/16 of an inch and no greater than 3/32 of an inch.

47. A reclosable package according to claim 45 wherein:

the door of one of the surfaces is disposed at one end of the enclosure and comprises a lip that engages an upraised wall of the another one of the surfaces when the door is disposed in the closed position;

each of the surfaces, including the outer peripheral flanges of each the surfaces, is comprised of a vinyl or a PETG having thickness no greater than 0.050 inches; and wherein the at least one seal comprises a seal produced by an energy welding process.

48. A reclosable package according to claim 47 wherein the reclosable package has a width of less than two inches, a first of the reclosable packages can be received on a first peg, a second of the reclosable packages can be received on a second peg, and wherein the first and second pegs are spaced apart about two inches.

49. A reclosable package according to claim 48 wherein the reclosable package has a length of at least twenty and one-half inches and the article has a length that is at least five times the maximum width of the reclosable package.

50. A reclosable package according to claim 49 wherein the article comprises a wiper blade or a wiper blade refill.

51. A reclosable package comprising a pair of spaced apart surfaces that define an enclosure with one of the surfaces having a door that has a closed position where the door overlies an access opening and an open position disposed away from the closed position such that the access opening is exposed such that an article in the package can be removed from the package; and (a) a pair of spaced apart sidewalls between the surfaces defining a package having a generally rectangular cross section, and (b) a rib about the periphery of the surface having the door wherein the rib has two longitudinally-extending rib sections with each of the longitudinally-extending rib sections having a notch that creates a region of weakness in each of the longitudinally-extending rib sections along which the door bends when moved away from the closed position.

52. The reclosable package according to claim 51 wherein one of the surfaces has a first portion that mates with a first portion of another of the surfaces along a first plane and the one of the surfaces has a second portion that mates with a second portion of the another of the surfaces along a second plane that is disposed at an angle relative to the first plane.

53. The reclosable package according to claim 52 wherein each of the notches is comprised of a hinge rib formed in each longitudinally-extending rib section.

54. The reclosable package according to claim 53 wherein each hinge rib extends transversely relative to one of the longitudinally-extending rib section and comprises a first inclined surface disposed at an angle relative to a second inclined surface when the door is disposed in a closed position.

55. A reclosable package comprising:

(a) a pair of surfaces that overlie each other and that are spaced apart, defining an enclosure, with a door formed in one of the surfaces, the door being disposed adjacent one end of the enclosure and 1) having a closed position, 2) having an open position disposed away from the closed position, and 3) bending along a fold line when being moved away from the closed position;

(b) wherein the one of the surfaces carrying the door further comprises a longitudinally-extending rib that (i) extends across the fold line, and (ii) has a notch in the longitudinally-extending rib that is disposed along the fold line;

(c) wherein the one of the surfaces is joined to the other of the surfaces along a first plane;

(d) wherein the door releasably mates with the other of the surfaces along a second plane when the door is closed; and (e) wherein the first plane is disposed at an angle relative to the second plane.

56. A package according to claim 55 wherein:

1) the one of the surfaces comprises i) a first pair of substantially coplanar spaced apart and generally longitudinally extending outer peripheral flanges disposed substantially parallel to the first plane, and ii) a second pair of substantially coplanar spaced apart and longitudinally extending outer peripheral flanges disposed substantially parallel to the second plane;

2) the other of the surfaces comprises i) a third pair of substantially coplanar spaced apart and generally longitudinally extending outer peripheral flanges disposed substantially parallel to the first plane, and ii) a fourth pair of substantially coplanar spaced apart and generally longitudinally extending outer peripheral flanges disposed substantially parallel to the second plane when the door is disposed in the closed position;

3) at least one seal joins at least a portion of each one of the flanges of the first pair of flanges to one of the flanges of the third pair of flanges;

4) each one of the flanges of the second pair of flanges overlies one of the flanges of the fourth pair of flanges; and 5) the flanges of the second pair of flanges are not attached to the flanges of the fourth pair of flanges and define the door.

57. A reclosable package comprising:

(a) a pair of spaced apart surfaces that define an enclosure with one of the surfaces having a door that has a closed position and an open position disposed away from the closed position;

(b) a recessed rib disposed around but inboard of the periphery of the surface having the door wherein the recessed rib has two longitudinally-extending recessed rib sections with each of the longitudinally-extending recessed rib sections having a notch defining a fold line along which the door bends when being moved away from the closed position;

(c) wherein the one of the surfaces is joined to the other of the surfaces along a first plane;

(d) wherein the door releasably mates with the other of the surfaces along a second plane when the door is disposed in the closed position; and (e) wherein the first plane is disposed at an angle relative to the second plane.

58. A package according to claim 57 wherein:

1) the one of the surfaces comprises i) a first pair of substantially coplanar spaced apart and generally longitudinally extending outer peripheral flanges disposed substantially parallel to the first plane, and ii) a second pair of substantially coplanar spaced apart and longitudinally extending outer peripheral flanges disposed substantially parallel to the second plane;

2) the other of the surfaces comprises i) a third pair of substantially coplanar spaced apart and generally longitudinally extending outer peripheral flanges disposed substantially parallel to the first plane, and ii) a fourth pair of substantially coplanar spaced apart and generally longitudinally extending outer peripheral flanges disposed substantially parallel to the second plane when the door is disposed in the closed position;

3) at least one seal joins at least a portion of each one of the flanges of the first pair of flanges to one of the flanges of the third pair of flanges;

4) each one of the flanges of the second pair of flanges overlies one of the flanges of the fourth pair of flanges; and 5) the flanges of the second pair of flanges are not attached to the flanges of the fourth pair of flanges and define the door.

59. The reclosable package according to claim 57 wherein the door is disposed at one end of the reclosable package, the notch comprises a hinge-rib in each of the longitudinally-extending rib sections, and the fold line extends generally transversely from one of the hinge ribs to the other of the hinge ribs.

60. The reclosable package according to claim 57 further comprising a pair of spaced apart sidewalls and a pair of spaced apart endwalls disposed between the pair of the surfaces wherein the door is releasably retained in the closed position by engagement between the door and one of the endwalls, wherein the door is disposed at one end of the reclosable package, and wherein the one of the endwalls has a width measured in a direction perpendicular to transverse and longitudinal relative to the reclosable package that is less than a width of the other of the endwalls measured in the direction perpendicular to transverse and longitudinal relative to the reclosable package.

* * * * *